US006882333B2

(12) United States Patent
Komura et al.

(10) Patent No.: US 6,882,333 B2
(45) Date of Patent: Apr. 19, 2005

(54) DISPLAY METHOD AND DISPLAY APPARATUS THEREFOR

(75) Inventors: Shinichi Komura, Hitachi (JP); Tetsuya Aoyama, Hitachi (JP); Ikuo Hiyama, Hitachi (JP); Tsunenori Yamamoto, Hitachi (JP); Hiroshi Kageyama, Hitachi (JP); Shinya Ohtsuji, Tokai-mura (JP)

(73) Assignee: Hitachi, Ltd., Tokyo (JP)

( * ) Notice: Subject to any disclaimer, the term of this patent is extended or adjusted under 35 U.S.C. 154(b) by 335 days.

(21) Appl. No.: 09/876,119

(22) Filed: Jun. 8, 2001

(65) Prior Publication Data

US 2002/0018041 A1 Feb. 14, 2002

(30) Foreign Application Priority Data

Jun. 9, 2000 (JP) ..... 2000-172940
Jul. 24, 2000 (JP) ..... 2000-221812

(51) Int. Cl.[7] ..... G09G 3/36
(52) U.S. Cl. ..... 345/98; 345/90; 345/100
(58) Field of Search ..... 345/87–104, 690–699, 345/204–215; 382/298–299, 300; 348/581

(56) References Cited

U.S. PATENT DOCUMENTS 4,859,997 A * 8/1989 Bouron et al. ..... 345/204
5,168,270 A * 12/1992 Masumori et al. ..... 345/100
5,365,284 A * 11/1994 Matsumoto et al. ..... 345/100
5,479,188 A * 12/1995 Moriyama ..... 345/89
5,485,293 A * 1/1996 Robinder ..... 345/88
5,568,163 A * 10/1996 Okumura ..... 345/100
5,754,698 A * 5/1998 Suzuki et al. ..... 382/232
5,801,841 A * 9/1998 Suzuki ..... 382/234
5,805,128 A * 9/1998 Kim et al. ..... 345/96
5,838,455 A * 11/1998 Imaizumi et al. ..... 358/3.1
5,872,554 A * 2/1999 Chang et al. ..... 345/690
5,877,737 A * 3/1999 Kim et al. ..... 345/89
5,896,137 A * 4/1999 Ito et al. ..... 345/619
5,903,250 A * 5/1999 Lee et al. ..... 345/100
5,903,360 A * 5/1999 Honma et al. ..... 358/450
5,977,940 A * 11/1999 Akiyama et al. ..... 345/94
5,986,641 A * 11/1999 Shimamoto ..... 345/204
6,037,923 A * 3/2000 Suzuki ..... 345/90
6,175,355 B1 * 1/2001 Reddy ..... 345/691
6,310,592 B1 * 10/2001 Moon et al. ..... 345/90
6,476,785 B1 * 11/2002 Pathak et al. ..... 345/90
6,507,350 B1 * 1/2003 Wilson ..... 345/690
6,515,647 B1 * 2/2003 Sakamoto ..... 345/100
6,560,375 B1 * 5/2003 Hathaway et al. ..... 382/295

* cited by examiner

*Primary Examiner*—Chanh Nguyen
*Assistant Examiner*—Paul A. Bell
(74) *Attorney, Agent, or Firm*—Dickstein Shapiro Morin & Oshinsky LLP

(57) ABSTRACT

A display apparatus which can display a ultra-high definition picture and high-speed animation is provided. The input picture signal is connected by signal generation circuit which supplies a desired signal to X driver according to n-gradation approximation picture signal output from n-gradation approximation calculating circuit to convert into n-gradation approximation picture signal approximated to binary gradation in every block and n-gradation approximation calculating circuit, Y driver, common voltage generating circuit, signal supply circuit and X driver, and a plurality of pixel parts connected by X signal line and Y driver which extends in the Y direction, and provided to the intersection parts of Y signal line which expands in the X direction.

5 Claims, 21 Drawing Sheets

FIG. 5

SELECTION PERIOD $t_1$:
LINES 1 TO 4
$V_{in}(t_1)=(V_X(t_1)+V_X(t_1))/2$
$=(V_X(t_1)+20j/2 \geqq 6$ LINES 5 TO 8
$V_{in}(t_1)=(V_X(t_1)+V_X(t_1))/2$
$=(V_X(t_1)+0j/2 \leqq 4$ $V_X(t_1)$

| $Y_Y(t_1)$ | 4 | 8 | 8 | 4 | 0 | -4 | -8 | -8 |
|---|---|---|---|---|---|---|---|---|
| 20 | 12 | 14 | 14 | 12 | 10 | 6 | 6 | 6 |
| 20 | 12 | 14 | 14 | 12 | 10 | 6 | 6 | 6 |
| 20 | 12 | 14 | 14 | 12 | 10 | 6 | 6 | 6 |
| 20 | 12 | 14 | 14 | 12 | 10 | 6 | 6 | 6 |
| 0 | 2 | 4 | 4 | 2 | 0 | -2 | -4 | -4 |
| 0 | 2 | 4 | 4 | 2 | 0 | -2 | -4 | -4 |
| 0 | 2 | 4 | 4 | 2 | 0 | -2 | -4 | -4 |
| 0 | 2 | 4 | 4 | 2 | 0 | -2 | -4 | -4 |

(a)

SELECTION PERIOD $t_2$:
LINES 1 TO 4
$V_{in}(t_2)=(V_X(t_2)+V_X(t_2))/2$

LINES 5 TO 8
$V_{in}(t_2)=(V_X(t_2)+V_X(t_2))/2$
$=(V_X(t_2)+20j/2 \geqq 6$ $V_X(t_2)$

| $Y_Y(t_2)$ | 0 | -4 | -4 | 0 | 4 | 0 | -4 | -8 |
|---|---|---|---|---|---|---|---|---|
| 4 | 2 | 0 | 0 | 2 | 4 | 2 | 0 | -2 |
| 8 | 4 | 2 | 2 | 4 | 10 | 4 | 2 | 0 |
| 12 | 12 | 4 | 4 | 12 | 10 | 6 | 4 | 2 |
| 16 | 12 | 14 | 14 | 12 | 10 | 6 | 6 | 4 |
| 20 | 2 | 4 | 4 | 2 | 0 | -2 | -4 | -4 |
| 20 | 2 | 4 | 4 | 2 | 0 | -2 | -4 | -4 |
| 20 | 2 | 4 | 4 | 2 | 0 | -2 | -4 | -4 |
| 20 | 2 | 4 | 4 | 2 | 0 | -2 | -4 | -4 |

(b)

SELECTION PERIOD $t_3$:
LINES 1 TO 4
$V_{in}(t_3)=(V_X(t_3)+V_X(t_3))/2$
$=(V_X(t_3)+0j/2 \leqq 4$ LINES 5 TO 8
$V_{in}(t_3)=(V_X(t_3)+V_X(t_3))/2$ $V_X(t_3)$

| $Y_Y(t_3)$ | -4 | 0 | 0 | 0 | 0 | -4 | -8 | -8 |
|---|---|---|---|---|---|---|---|---|
| 0 | -2 | 0 | 0 | 0 | 0 | -2 | -4 | -4 |
| 0 | -2 | 0 | 0 | 0 | 0 | -2 | -4 | -4 |
| 0 | -2 | 0 | 0 | 0 | 0 | -2 | -4 | -4 |
| 0 | -2 | 0 | 0 | 0 | 0 | -2 | -4 | -4 |
| 4 | 0 | 2 | 2 | 2 | 2 | 0 | -2 | -2 |
| 8 | 2 | 4 | 4 | 4 | 4 | 2 | 0 | 0 |
| 12 | 4 | 6 | 6 | 6 | 6 | 4 | 2 | 2 |
| 16 | 6 | 8 | 8 | 8 | 8 | 6 | 4 | 4 |

(c)

FIG. 8

SELECTION PERIOD $t_1$:
LINES 1 TO 4
$V_{in}(t_1)=V_X(t_1)\geqq 6$

LINES 5 TO 8
HOLDING $V_{in}(t_1)\leqq 4$ $V_X(t_1)$

| $Y_Y(t_1)$ | 10 | 8 | 8 | 10 | 12 | 10 | 8 | 6 |
|---|---|---|---|---|---|---|---|---|
| 10 | 10 | 8 | 8 | 10 | 12 | 10 | 8 | 6 |
| 10 | 10 | 8 | 8 | 10 | 12 | 10 | 8 | 6 |
| 10 | 10 | 8 | 8 | 10 | 12 | 10 | 8 | 6 |
| 10 | 10 | 8 | 8 | 10 | 12 | 10 | 8 | 6 |
| 0 | * | * | * | * | * | * | * | * |
| 0 | * | * | * | * | * | * | * | * |
| 0 | * | * | * | * | * | * | * | * |
| 0 | * | * | * | * | * | * | * | * |

(a)

SELECTION PERIOD $t_2$:
LINES 1 TO 4
$V_{in}(t_2)=V_X(t_1)+V_Y(t_2)-10$ $V_{in}(t_2)=V_X(t_2)\geqq 6$ $V_X(t_2)$

| $Y_Y(t_2)$ | 8 | 10 | 10 | 10 | 10 | 8 | 6 | 6 |
|---|---|---|---|---|---|---|---|---|
| 2 | 2 | 0 | 0 | 2 | 4 | 2 | 0 | -2 |
| 4 | 4 | 2 | 2 | 4 | 6 | 4 | 2 | 0 |
| 6 | 6 | 4 | 4 | 6 | 8 | 6 | 4 | 2 |
| 8 | 8 | 6 | 6 | 8 | 10 | 8 | 6 | 4 |
| 10 | 8 | 10 | 10 | 10 | 10 | 8 | 6 | 6 |
| 10 | 8 | 10 | 10 | 10 | 10 | 8 | 6 | 6 |
| 10 | 8 | 10 | 10 | 10 | 10 | 8 | 6 | 6 |
| 10 | 8 | 10 | 10 | 10 | 10 | 8 | 6 | 6 |

(b)

SELECTION PERIOD $t_3$:
LINES 1 TO 4
HOLDING $V_{in}(t_3)=V_X(t_1)-10\leqq 4$

LINES 5 TO 8
$V_{in}(t_3)=V_X(t_2)+V_Y(t_3)-10$ $V_X(t_3)$

| $Y_Y(t_3)$ | -4 | 0 | 0 | 0 | 0 | -4 | -8 | -8 |
|---|---|---|---|---|---|---|---|---|
| 0 | -2 | 0 | 0 | 0 | 0 | -2 | -4 | -4 |
| 0 | -2 | 0 | 0 | 0 | 0 | -2 | -4 | -4 |
| 0 | -2 | 0 | 0 | 0 | 0 | -2 | -4 | -4 |
| 0 | -2 | 0 | 0 | 0 | 0 | -2 | -4 | -4 |
| 2 | 0 | 2 | 2 | 2 | 2 | 0 | -2 | -2 |
| 4 | 2 | 4 | 4 | 4 | 4 | 2 | 0 | 0 |
| 6 | 4 | 6 | 6 | 6 | 6 | 4 | 2 | 2 |
| 8 | 6 | 8 | 8 | 8 | 8 | 6 | 4 | 4 |

(c)

FIG. 10

SELECTION PERIOD $t_1$:
LINES 1 TO 4
$V_{in}(t_1)=V_X(t_1)\geqq 6$

LINES 5 TO 8
HOLDING $V_{in}(t_1)\leqq 4$ $V_X(t_1)$

| $Y_Y(t_1)$ | 10 | 8 | 8 | 10 | 12 | 10 | 8 | 6 |
|---|---|---|---|---|---|---|---|---|
| 10 | 10 | 8 | 8 | 10 | 12 | 10 | 8 | 6 |
| 10 | 10 | 8 | 8 | 10 | 12 | 10 | 8 | 6 |
| 10 | 10 | 8 | 8 | 10 | 12 | 10 | 8 | 6 |
| 10 | 10 | 8 | 8 | 10 | 12 | 10 | 8 | 6 |
| 0 | * | * | * | * | * | * | * | * |
| 0 | * | * | * | * | * | * | * | * |
| 0 | * | * | * | * | * | * | * | * |
| 0 | * | * | * | * | * | * | * | * |

(a)

SELECTION PERIOD $t_2$:
LINES 1 TO 4
$V_{in}(t_2)=V_X(t_1)+V_Y(t_2)-10$

HOLDING $V_{in}(t_1)\leqq 4$ $V_X(t_2)$

| $V_Y(t_2)$ | 8 | 10 | 10 | 10 | 10 | 8 | 6 | 6 |
|---|---|---|---|---|---|---|---|---|
| 2 | 2 | 0 | 0 | 2 | 4 | 2 | 0 | -2 |
| 4 | 4 | 2 | 2 | 4 | 6 | 4 | 2 | 0 |
| 6 | 6 | 4 | 4 | 6 | 8 | 6 | 4 | 2 |
| 8 | 8 | 6 | 6 | 6 | 10 | 8 | 6 | 4 |
| 10 | * | * | * | * | * | * | * | * |
| 10 | * | * | * | * | * | * | * | * |
| 10 | * | * | * | * | * | * | * | * |
| 10 | * | * | * | * | * | * | * | * |

(b)

SELECTION PERIOD $t_3$:
LINES 1 TO 4
HOLDING $V_{in}(t_3)=V_X(t_1)-10\leqq 4$

LINES 5 TO 8
$V_{in}(t_3)=V_X(t_3)\geqq 6$ $V_X(t_3)$

| $Y_Y(t_3)$ | -4 | 0 | 0 | 0 | 0 | -4 | -8 | -8 |
|---|---|---|---|---|---|---|---|---|
| 0 | -2 | 0 | 0 | 0 | 0 | -2 | -4 | -4 |
| 0 | -2 | 0 | 0 | 0 | 0 | -2 | -4 | -4 |
| 0 | -2 | 0 | 0 | 0 | 0 | -2 | -4 | -4 |
| 0 | -2 | 0 | 0 | 0 | 0 | -2 | -4 | -4 |
| 2 | 8 | 10 | 10 | 10 | 10 | 8 | 6 | 6 |
| 4 | 8 | 10 | 10 | 10 | 10 | 8 | 6 | 6 |
| 6 | 8 | 10 | 10 | 10 | 10 | 8 | 6 | 6 |
| 8 | 8 | 10 | 10 | 10 | 10 | 8 | 6 | 6 |

(c)

FIG. 13

SELECTION PERIOD $t_1$:
LINES 1 TO 4
$V_{in}(t_1)=V_X(t_1)\geqq 6$

LINES 5 TO 8
HOLDING $V_{in}(t_1)\leqq 4$ $V_X(t_1)$

| $Y_Y(t_1)$ | 10 | 8 | 8 | 10 | 12 | 10 | 8 | 6 |
|---|---|---|---|---|---|---|---|---|
| 10 | 10 | 8 | 8 | 10 | 12 | 10 | 8 | 6 |
| 10 | 10 | 8 | 8 | 10 | 12 | 10 | 8 | 6 |
| 10 | 10 | 8 | 8 | 10 | 12 | 10 | 8 | 6 |
| 10 | 10 | 8 | 8 | 10 | 12 | 10 | 8 | 6 |
| 0 | * | * | * | * | * | * | * | * |
| 0 | * | * | * | * | * | * | * | * |
| 0 | * | * | * | * | * | * | * | * |
| 0 | * | * | * | * | * | * | * | * |

(a)

SELECTION PERIOD $t_2$:
LINES 1 TO 4
$V_{in}(t_2)=V_X(t_1)+V_Y(t_2)-10$ $V_{in}(t_2)=V_X(t_2)\geqq 6$ $V_X(t_2)$

| $V_Y(t_2)$ | 8 | 10 | 10 | 10 | 10 | 8 | 6 | 6 |
|---|---|---|---|---|---|---|---|---|
| 2 | 2 | 0 | 0 | 2 | 4 | 2 | 0 | -2 |
| 4 | 4 | 2 | 2 | 4 | 6 | 4 | 2 | 0 |
| 6 | 6 | 4 | 4 | 6 | 8 | 6 | 4 | 2 |
| 8 | 8 | 6 | 6 | 8 | 10 | 8 | 6 | 4 |
| 10 | 8 | 10 | 10 | 10 | 10 | 8 | 6 | 6 |
| 10 | 8 | 10 | 10 | 10 | 10 | 8 | 6 | 6 |
| 10 | 8 | 10 | 10 | 10 | 10 | 8 | 6 | 6 |
| 10 | 8 | 10 | 10 | 10 | 10 | 8 | 6 | 6 |

(b)

SELECTION PERIOD $t_3$:
LINES 1 TO 4
HOLDING $V_{in}(t_3)=V_X(t_1)-10\leqq 4$

LINES 5 TO 8
$V_{in}(t_3)=V_X(t_2)+V_Y(t_3)-10$ $V_X(t_3)$

| $Y_Y(t_3)$ | 14 | 10 | 8 | 6 | 6 | 10 | 10 | 12 |
|---|---|---|---|---|---|---|---|---|
| 0 | 0 | -2 | -2 | 0 | 2 | 0 | -2 | -4 |
| 0 | 0 | -2 | -2 | 0 | 2 | 0 | -2 | -4 |
| 0 | 0 | -2 | -2 | 0 | 2 | 0 | -2 | -4 |
| 0 | 0 | -2 | -2 | 0 | 2 | 0 | -2 | -4 |
| 2 | 0 | 2 | 2 | 2 | 2 | 0 | -2 | -2 |
| 4 | 0 | 4 | 4 | 4 | 4 | 2 | 0 | 0 |
| 6 | 4 | 6 | 6 | 6 | 6 | 4 | 2 | 2 |
| 8 | 6 | 8 | 8 | 8 | 8 | 6 | 4 | 4 |

(c)

FIG. 15

SELECTION PERIOD $t_1$:
LINES 1 TO 4
$V_{in}(t_1)=V_X(t_1)$

LINES 5 TO 8
HOLDING $V_{in}(t_1) \leqq 4$ $V_X(t_1)$

| $V_Y(t_1)$ | 2 | 6 | 6 | 8 | 10 | 8 | 6 | 4 |
|---|---|---|---|---|---|---|---|---|
| 6 | 2 | 6 | 6 | 8 | 10 | 8 | 6 | 4 |
| 6 | 2 | 6 | 6 | 8 | 10 | 8 | 6 | 4 |
| 6 | 2 | 6 | 6 | 8 | 10 | 8 | 6 | 4 |
| 6 | 2 | 6 | 6 | 8 | 10 | 8 | 6 | 4 |
| 0 | * | * | * | * | * | * | * | * |
| 0 | * | * | * | * | * | * | * | * |
| 0 | * | * | * | * | * | * | * | * |
| 0 | * | * | * | * | * | * | * | * |

(a)

SELECTION PERIOD $t_2$:
LINES 1 TO 4
$V_{in}(t_2)=V_X(t_1)+4 \geqq 6$ $V_{in}(t_2)=V_X(t_2)$ $V_X(t_2)$

| $V_Y(t_2)$ | 4 | 6 | 6 | 6 | 6 | 4 | 2 | 2 |
|---|---|---|---|---|---|---|---|---|
| 10 | 6 | 10 | 10 | 12 | 14 | 12 | 10 | 8 |
| 10 | 6 | 10 | 10 | 12 | 14 | 12 | 10 | 8 |
| 10 | 6 | 10 | 10 | 12 | 14 | 12 | 10 | 8 |
| 10 | 6 | 10 | 10 | 12 | 14 | 12 | 10 | 8 |
| 6 | 4 | 6 | 6 | 6 | 6 | 4 | 2 | 2 |
| 6 | 4 | 6 | 6 | 6 | 6 | 4 | 2 | 2 |
| 6 | 4 | 6 | 6 | 6 | 6 | 4 | 2 | 2 |
| 6 | 4 | 6 | 6 | 6 | 6 | 4 | 2 | 2 |

(b)

SELECTION PERIOD $t_3$:
LINES 1 TO 4
$V_{in}(t_3)=V_X(t_1)+V_Y(t_3)-6$

LINES 5 TO 8
$V_{in}(t_3)=V_X(t_2)+4 \geqq 6$ $V_X(t_3)$

| $V_Y(t_3)$ | 10 | 8 | 6 | 2 | 2 | 4 | 6 | 8 |
|---|---|---|---|---|---|---|---|---|
| 2 | -2 | 2 | 2 | 4 | 6 | 4 | 2 | 0 |
| 4 | 0 | 4 | 4 | 6 | 8 | 6 | 4 | 2 |
| 6 | 2 | 6 | 6 | 8 | 10 | 8 | 6 | 4 |
| 8 | 4 | 8 | 8 | 10 | 12 | 8 | 8 | 6 |
| 10 | 8 | 10 | 10 | 10 | 10 | 8 | 6 | 6 |
| 10 | 8 | 10 | 10 | 10 | 10 | 8 | 6 | 6 |
| 10 | 8 | 10 | 10 | 10 | 10 | 8 | 6 | 6 |
| 10 | 8 | 10 | 10 | 10 | 10 | 8 | 6 | 6 |

(c)

DISPLAY METHOD AND DISPLAY APPARATUS THEREFOR

BACKGROUND OF THE INVENTION

The present invention relates to a display method and a display apparatus. Especially, the present invention relates to an ultra high definition apparatus and a display apparatus with a high drive frequency.

A line-sequential scanning method, in which the scanning pulse is applied to each scanning electrode at the interval of one frame once, is adopted in the drive for the conventional TFT active matrix type liquid crystal display.

As one frame time, about 1/60 seconds are frequently used. Usualy, the scanning pulse is applied from the upper part of the panel to the bottom part while shifting timing one by one. Therefore, the time width of the scanning pulse is about 35 μs, because 480 gate wirings are scanned during one frame in the liquid crystal display apparatus with the pixels of 640×480 dots.

On the other hand, a liquid crystal drive voltage to apply to the liquid crystal of the pixels corresponding to one line to which the scanning pulse is applied is simultaneously applied to the signal electrodes in synchronization with the scanning pulse. It is necessary to input the pixel signal which corresponds to the liquid crystal drive voltage applied to the liquid crystal of the pixels of the next row to all signal electrodes in time that the scanning pulse is applied to the scanning electrodes at the previous and one row. In the liquid crystal display apparatus of 640×480 dots, the pixel signals corresponding to 640 rows are input during the time width of the scanning pulse (about 35 μs). Therefore, the time allocated to one pixel signal is about 35 μs/640=55 ns.

In the selection pixel to which the gate pulse is applied, the gate electrode voltage of a TFT connected to scanning electrode increases. Therefore, TFT becomes an on-state. At this time, the liquid crystal drive voltage is applied to the display electrode via source-to-drain of TFT. As a result, the pixel capacity is charged during the above-mentioned 35 μs. The pixel capacity is the total capacity of the liquid crystal capacity formed between the display electrode and the opposed electrode and the load capacity arranged in the pixel. By repeating this charge operation, the liquid crystal applied voltage is repeatedly applied to the pixel capacity in the whole area of the panel each frame-time.

The conventional TFT active matrix type liquid crystal display apparatus is driven as described above. Therefore, when the display becomes high definition, and the number of pixels to be displayed increases, the time width of the scanning pulse and the time allocated to input one pixel signal shorten. That is, it is necessary to charge the pixel capacity in a short time. Further, it is necessary to input the pixel signal in a shorter time.

On the other hand, it is necessary to shorten one frame time further to support the high-speed animation. Also in this case, the time width of the scanning pulse and the time allocated to input one pixel signal shorten.

As mentioned above, it is necessary to charge the liquid crystal drive voltage to the pixel capacity in a short time to display the high definition picture or high-speed animation. The liquid crystal drive voltage is supplied to the pixel capacity by driving circuit provided at the edge portion through signal electrode lines. In that case, the delay is caused in the liquid crystal drive voltage supplied to the pixel capacity by the wiring delay in the signal electrode line. It is necessary to set the time width of the scanning pulse very long compared with this delay time in order to display the normal picture.

However, because the time width of the scanning pulse cannot be set enough long in the prior art, the normal high definition picture or high-speed animation cannot be displayed.

Further, it is necessary to input in a shorter time the pixel signal to the liquid crystal display apparatus, in order to display a high definition picture or high-speed animation. That is, it is required to increase the frequency of the signal input to liquid crystal display apparatus. However, there is a problem that the pixel signal is not accurately input to the liquid crystal display apparatus owing to the wiring delay of the cable for inputting the signal to the liquid crystal display apparatus. Therefore, the desired picture can not be displayed.

SUMMARY OF THE INVENTION

An object of the present invention is to provide a display method and a display apparatus which can display a high definition picture or high-speed animation.

To achieve the above-mentioned object, the next display method is adopted in one aspect of the present invention. That is, the display method in which a display signal for displaying a picture is independently applied to each of the pixels arranged like the matrix by using the wiring arranged in the directions of row and column, comprising the steps of:

dividing the pixels into pixel blocks of N rows×N' columns, and allocating the gradation of n values which are less number than N×N' to each of the pixels of a pixel block formed from N×N' pixels.

The picture can be displayed by dividing said pixel block into the areas of n pieces, and allocating the gradation of the same value to each of the divided areas. said pixel block can comprise only the pixels in the same column.

One gradation among n-gradation given to the pixel block is given to all pixels of the pixel block in the next N rows×N' columns for the same period as that when the signal is given to the pixel where one gradation among the n-gradation which corresponds to the pixel block is allocated for the pixel block of N rows×N' columns.

According to another aspect of the present invention, the next display method is provided.

That is, the display method in which a display signal for displaying a picture is independently applied to each of the pixels arranged like the matrix by using the wiring arranged in the directions of column and column, comprising the steps of:

dividing the pixels into pixel blocks of N rows ×N' columns, and providing signals to the pixels of n lines in a selection period of n times which are less number than N.

According to a further aspect of the present invention, the following display apparatus is provided.

That is, the display apparatus according to the present invention, comprises:

pixel electrodes arranged like a matrix, display elements which operate according to the voltage of the pixel electrode;

an X driver for supplying an X signal to X signal line arranged in the column direction;

an Y driver for supplying an Y signal to Y signal line arranged in the row direction;

a liquid crystal drive voltage supplying circuit for supplying a liquid crystal drive voltage to a liquid crystal drive voltage line arranged in a column direction;

an XY calculating circuit provided at the intersection parts of the X signal line and the Y signal line and connected to the X signal line and the Y signal line for calculating and outputting the X and Y signals;

a signal comparator for comparing an output of the XY calculating circuit with a reference voltage and outputting a first voltage when the the output of the XY calculating circuit is higher than the reference voltage, and a second voltage when lower than that;

a switch for controlling the connection of the pixel electrode and the liquid crystal drive voltage line, based on the output of the signal comparator;

n-gradation approximation calculating circuit for dividing the pixels into pixel blocks of N rows×N' columns, and converting the gradation level of each pixel of each block into n-gradation approximation picture signal approximated to n values less than N×N', and a signal control circuit for controlling the X driver, the Y driver, and liquid crystal drive voltage supplying circuit, according to the n-gradation approximation picture signal.

In the case that n is two, the XY calculating circuit comprises two capacitors connected in series between the X signal line and the Y signal line. The voltage of the connection node of two capacitors is input to the signal comparator as an output value. Voltage VYMAX applied to Y signal line is a high voltage enough to allow the output of the XY arithmatic circuit to be higher than the reference voltage of the signal comparator regardless of the voltage applied to X signal line. Voltage VYMIN applied to Y signal line is a high voltage enough to allow the output of the XY arithmatic circuit to be lower than the reference voltage of the signal comparator regardless of the voltage applied to X signal line. VYMAX is applied to Y signal lines of the first to N-th rows, and VYMIN is applied to Y signal lines other than the first to Nth row, for the first selection period. Next, the voltage VY1<VY2< . . . <VYN are applied to Y signal lines of the $1^{st}$ to N-th rows, VYMAX is applied to Y signal lines of the (N+1)-th to 2N-th rows, and VYMIN is applied to Y signal lines other than the first to 2Nth rows, for the second selection period. Hereafter, for the i-th selection period, the voltage VY1<VY2< . . . <VYN are applied to Y signal lines of the ((i−2)×N+1)-th to ((i−1)×N)-throws, VYMAX is applied to Y signal lines of the ((i−1)×N+1)-th to (i×N)-th rows, and VYMIN is applied to Y signal lines other than the ((i−2)×N+1)-th to (i×N)-th rows.

In the case that n is two, the XY calculating circuit may comprise a capacitor of which one terminal is connected to the Y signal line and the other terminal to a drain electrode, and a transistor of which a source electrode is connected to the X signal line. In this case, the voltage of the drain electrode of the transistor is input to the signal comparator as an output value. Voltage VYMAX applied to Y signal line is a high voltage enough to allow the output of the XY arithmatic circuit to be higher than the reference voltage of the signal comparator regardless of the voltage applied to X signal line. Voltage VYMIN applied to Y signal line is a high voltage enough to allow the output of the XY arithmatic circuit to be lower than the reference voltage of the signal comparator regardless of the voltage applied to X signal line. VYMAX is applied to Y signal lines of the 1st to N-th rows, and VYMIN is applied to Y signal lines other than the first to N-th row, for the first selection period. Next, the voltage VY1<VY2< . . . <VYN are applied to Y signal lines of the first to N-th rows, VYMAX is applied to Y signal lines of the (N+1)-th to 2N-th rows, and VYMIN is applied to Y signal lines other than the first to 2N-th rows, for the second selection period. Hereafter, for the i-th selection period, the voltage VY1<VY2< . . . <VYN are applied to Y signal lines of the ((i−2)×N+1)-th to ((i−1)×N)-th rows, VYMAX is applied to Y signal line of the ((i−1)×N+1)th to (i×N)th rows, and VYMIN is applied to Y signal lines other than the ((i−2)×N+1)-th to (i×N)-th rows.

In the case that n is two, the XY calculating circuit may comprise a capacitor of which one terminal is connected to the Y signal line and the other terminal to a drain electrode, and a transistor of which a source electrode is connected to the X signal line like the above-mentioned circuit. In this case, the voltage of the drain electrode of the transistor is input to the signal comparator as an output value. The voltage VYMAX applied to Y signal line is a high voltage enough to allow the output of the XY arithmatic circuit to be higher than the reference voltage of the signal comparator regardless of the voltage applied to X signal line. The voltage VYMIN applied to Y signal line is a high voltage enough to allow the output of the XY arithmatic circuit to be lower than the reference voltage of the signal comparator regardless of the voltage applied to X signal line. VYMAX is applied to Y signal lines of the first to N-th rows, and VYMIN is applied to Y signal lines other than the first to N-th rows, for the first selection period. Next, the voltage VY1<VY2< . . . <VYN are applied to Y signal lines of the first to N-th rows, and VYMIN is applied to Y signal lines other than the first to N-th rows, for the second selection period. Hereafter, for the (2×i−1)-th selection period (i=1, 2,3, . . . ), VYMAX is applied to Y signal lines of the ((i−1)×N+1)-th to (i×N)-th rows, and VYMIN is applied to Y signal lines other than the ((i×1)×N+1)-th to (i×N)-th rows.

Further, for the (2×i)-th selection period, the voltage VY1<VY2< . . . <VYN are applied to Y signal lines of the ((i−1)×N+1)-th to (i×N)-th rows, and VYMIN is applied to Y signal lines other than the ((i×1)×N+1) to (i×N)-th rows.

The following display apparatus can be achieved. In each of N' columns in i=1, 2, . . . 3 in such a display apparatus, the liquid crystal drive voltage lines of the ((2×i−2)×N+1)-th to ((2×i−1)×N)-th rows are connected to one another. Further, the liquid crystal drive voltage lines of the ((2×i−1)×N+1)-th to (2×i×N)-th rows is connected to one another. Further, the liquid crystal drive voltage lines of the ((2×i−2)×N+1)-th to ((2×i−1)×N)-th rows and the liquid crystal drive voltage lines of the ((2×i−1)×N+1)-th to (2×i×N)-th rows are not connected to one another.

In the case that n is two, the XY calculating circuit according to a further aspect of the present invention may comprise a capacitor of which one terminal is connected to the Y signal line and the other terminal to a drain electrode, and a transistor of which a source electrode is connected to the X signal line. In this case, the voltage of the drain electrode of the transistor is input to the signal comparator as an output value. Voltages VYMAX and VYMID applied to Y signal line are set to a high voltage enough to allow the value of VX+VYMAX+VMID to be higher than the reference voltage of the signal comparator regardless of the value of the voltage VX applied to X signal line. The voltage VYMIN applied to Y signal line is set to a high voltage enough to allow the output of the XY arithmatic circuit to be lower than the reference voltage of the signal comparator regardless of the voltage applied to X signal line.

For the first selection period VYMID is applied to Y signal lines of the first to N-th rows, and VYMIN is applied to Y signal lines other than the first to N-th rows. Next, for the second selection period, VYMAX is applied to Y signal lines of the first to N-th rows. Next, VYMID is applied to Y signal lines other than the (N+1)-th to 2N-th rows. Further, VYMIN is applied to Y signal lines other than the first to 2N-th rows. For the third selection period, the voltage VY1<VY2< . . . <VYN are applied to Y signal lines of the first to N-th rows, and VYMAX is applied to Y signal lines of the (N+1)-th to 2N-th rows. Further, VYMID is applied to Y signal lines of the (2N+1)-th to 3N-th rows, and VYMIN is applied to Y signal lines other than the first to 3N-th rows. Hereinafter, for the i-th selection period, the voltage VY1<VY2< . . . <VYN are applied to Y signal lines of the ((i−1)×N+1)-th to ((I−2)×N)-th rows. Further, VYMAX is applied to Y signal lines of the ((i−2)×N+1)-th to ((i−1)×N)-th rows, VYMID is applied to Y signal lines of the ((i−1)×N+1)-th to (i×N)-th rows, and VYMIN is applied to Y signal lines other than the ((i−3)×N+1)-th to (i×N)-th rows.

According to a further aspect of the present invention, the following display apparatus is provided.

That is, the display apparatus according to the present invention, comprises:

red color pixel electrodes, green color pixel electrodes, and blue color pixel electrodes arranged like a matrix;

display elements which operate according to the voltage of the pixel electrode;

an X driver for supplying an X signal to an X signal line arranged in the column direction;

an Y driver for supplying a Y signal to a Y signal line arranged in the row direction;

a liquid crystal drive voltage supplying circuit for supplying a liquid crystal drive voltage to liquid crystal drive voltage lines for red color, green color, and blue color arranged in a column direction;

an XY calculating circuit provided at the intersection parts of the X signal line and the Y signal line and connected to the X signal line and the Y signal line for calculating and outputting the X and Y signals;

a signal comparator for comparing an output of the XY calculating circuit with a reference voltage and outputting a first voltage when the the output of the XY calculating circuit is higher than the reference voltage, and a second voltage when lower than that;

a switch for controlling the connection of the red color pixel electrode and the red color liquid crystal drive voltage line, based on the output of the signal comparator;

a switch for controlling the connection of the green color pixel electrode and the green color liquid crystal drive voltage line, based on the output of the signal comparator;

a switch for controlling the connection of the green color pixel electrode and the green color liquid crystal drive voltage line, based on the output of the signal comparator;

n-gradation approximation calculating circuit for dividing the red color pixels, green color pixels and blue color pixels into pixel blocks of N rows×N' columns, and converting the color number formed by three pixels of the red color pixel, the green color pixel and the blue color pixel arranged adjacently in a column direction of each block into n-gradation approximation picture signal approximated to n values less than N×N', and a signal control circuit for controlling the X driver, the Y driver, and the liquid crystal drive voltage supplying circuit, according to the n-gradation approximation picture signal.

Concretely, said each pixel comprises:

a plurality of row lines arranged in a row direction, from which a VY signal is supplied;

a plurality of column lines arranged in a row direction, from which a VX signal is supplied;

pixel electrodes provided at intersection parts of row lines and column lines;

switching elements provided at the intersection parts of row lines and column lines, for controlling the connection of a data signal supply line and the pixel electrode, according to the calculating value of corresponding signal VX and signal VY.

Concretely, said each pixel comprises;

a plurality of row lines arranged in a row direction, for supplying a signal VY;

a plurality of column lines arranged in a column direction, for supplying a signal VX;

a red color pixel electrode, a green color pixel electrode, and a blue color pixel electrode, each provided at intersection parts of a row line and a column line;

switching elements tp for controlling the connection of a red color data signal supply line and a red color pixel electrode, the connection of a green color data signal supply line and a green color pixel electrode, and the connection of a blue color data signal supply line and a blue color pixel electrode to be in the same state, according to the calculation value of the corresponding VX signal and VY signal.

To achieve the above-mentioned object, the present invention provides the following display system.

In which said display system comprises:

either one of above-mentioned display apparatus;

a picture generating unit for instructing the display apparatus so as to display a picture; and a display control for inputting the picture signal to the display apparatus according to the instruction;

wherein said display apparatus has a means for allocating the gradation of n values to each pixel of the pixel block formed from N×N' pixels.

Further, the present invention provides the display system having the following configuration.

Namely, the display system comprises:

either one of above-mentioned display apparatus;

a picture generating unit for instructing the display apparatus so as to display a picture; and a display control for inputting the picture signal to the display apparatus according to the instruction;

wherein said display control has a means for allocating the gradation of n values to each pixel of the pixel block composed of N×N' pixels.

Further, the present invention provides the display system having the following configuration.

Namely, the display system comprises:

either one of above-mentioned display apparatus;

a picture generating unit for instructing the display apparatus so as to display a picture; and a display control for inputting the picture signal to the display apparatus according to the instruction;

wherein said picture generating unit has a means for allocating the gradation of n values to each pixel of the pixel block composed of N×N' pixels.

According to a further aspect of the present invention, the following display apparatus is provided.

That is, the display apparatus according to the present invention, comprises:

an X driver for supplying an X signal to an NX X signal lines arranged in the column direction;

an Y driver for supplying a Y signal to a NY Y signal lines arranged in the row direction;

a signal control circuit for controlling said X driver and said Y driver;

pixel electrodes provided at intersection parts of a X signal line and a Y signal line, and arranged like a matrix:

display elements which operates according to the voltage of the pixel electrode;

wherein the input picture signal corresponding to the picture to be displayed is input to the signal control circuit, the frame frequency is f(Hz), and when each of a red, a green, and a blue color is displayed with n bits, the data amount per unit time of the input picture signal is less than NX×NY×(3×n)×f bits/sec.

BRIEF DESCRIPTION OF THE DRAWINGS

FIG. 5 is a view illustrating the control operation of the display system of FIG. 1.

FIG. 8 is a view illustrating the control operation of the display system of FIG. 7.

FIG. 10 is a view illustrating the control operation of the display system in the embodiment 3.

FIG. 13 is a view illustrating the control operation of the display system of FIG. 12.

FIG. 15 a view illustrating the control operation of the display system in embodiment 5.

DETAILED DESCRIPTION OF THE PREFERRED EMBODIMENTS

Figure 1:
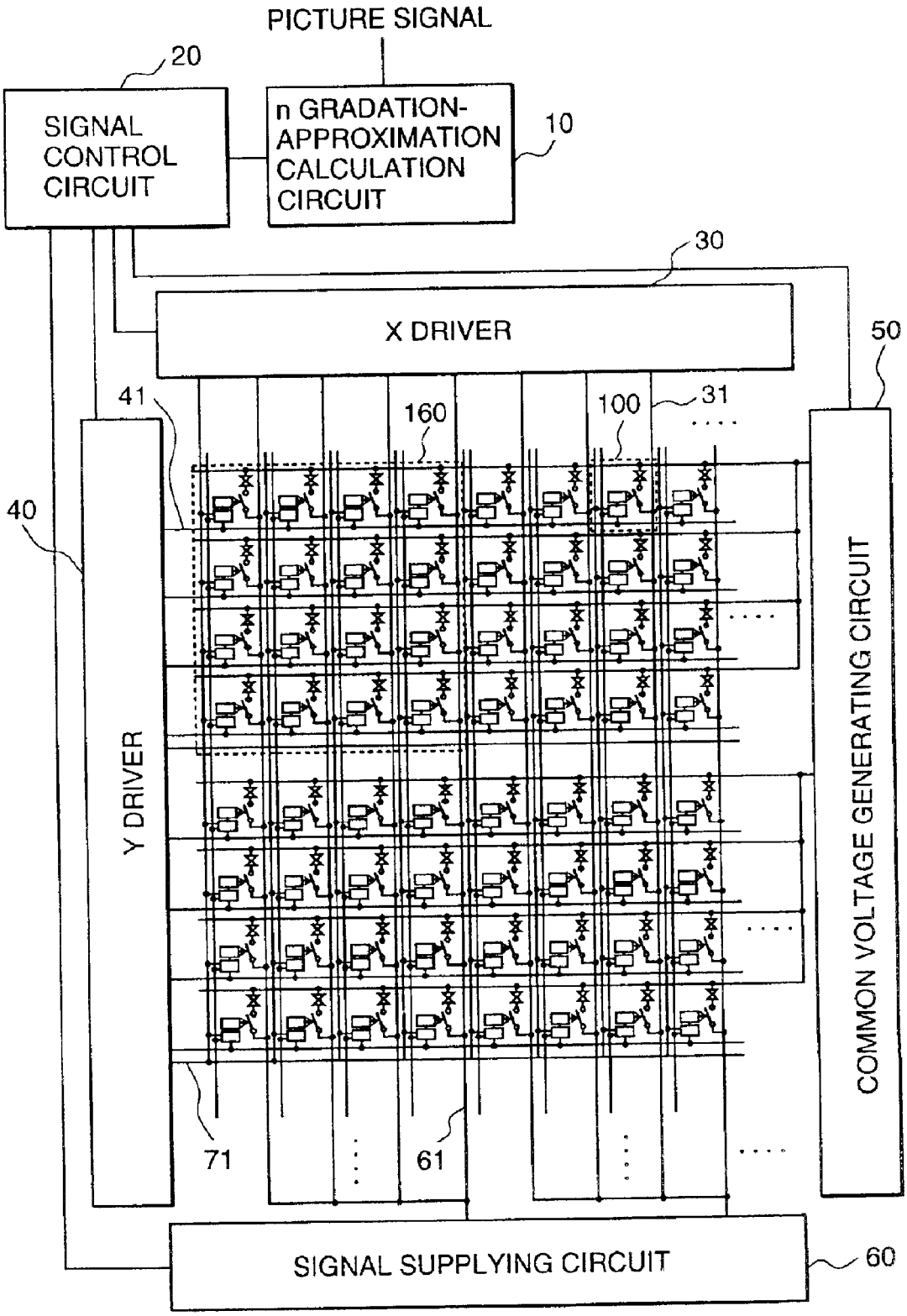
FIG. 1 shows whole configuration of embodiment 1 of the display system according to the present invention.
Figure 21:
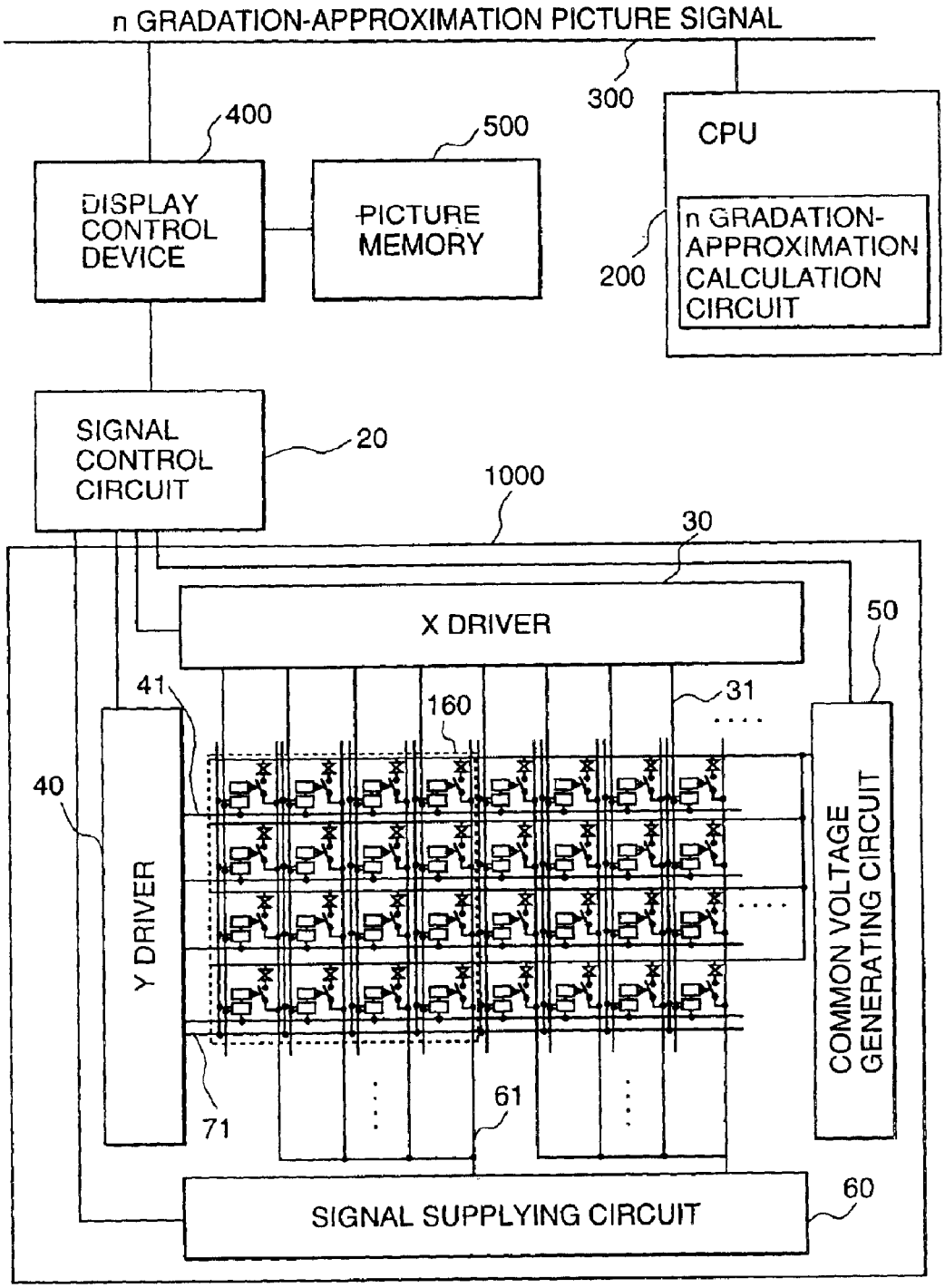
FIG. 21 shows whole configuration of embodiment 9 of the display system according to the present invention.

The embodiment of display apparatus according to the present invention is explained in detail referring in FIG. 21 next from FIG. 1.

[Embodiment 1]

FIG. 1 shows whole configuration of embodiment 1 of the display system according to the present invention. The display apparatus of this embodiment 1 has a n-gradation approximation calculating circuit 10 for converting an input picture signal into an n-gradation approximation picture signal approximated to binary gradation in every block, a signal generation circuit 20 for supplying a desired signal to an X driver 30, a Y driver 40, a common voltage generating circuit 50, and a signal supply circuit 60 according to the n-gradation approximation picture signal output from the n-gradation approximation calculating circuit 10, a plurality of pixel parts 100 provided at intersection parts of X signal lines 31 connected to the X driver 30 and extended in a Y direction and Y signal lines 41 connected to the Y driver 40 and extended in an X direction.

Figure 2:
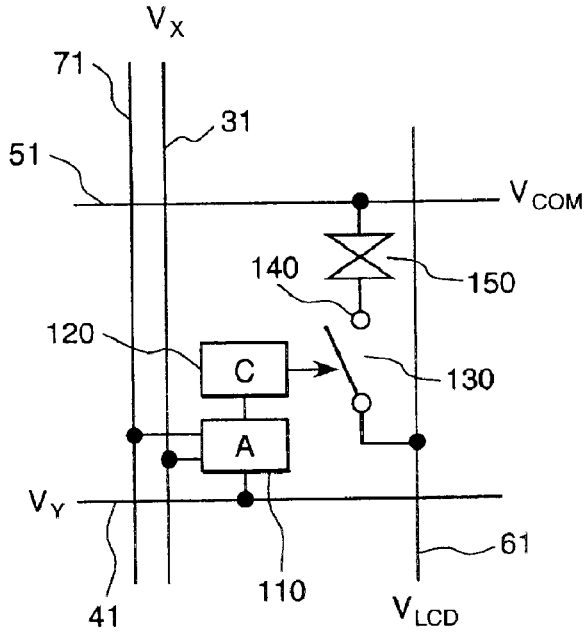
FIG. 2 shows one example of the circuit structure of pixel parts 100 of FIG. 1.

FIG. 2 shows one example of the circuit structure of pixel parts 100. A X signal VX is supplied to pixel parts 100 by the X driver 30 through the X signal line 31. A Y signal VY is supplied to pixel parts 100 by the Y driver 40 through the Y signal line 41. A Liquid crystal drive signal VLCD is supplied from the signal supply circuit 60 to the pixel parts 100 through the liquid crystal drive signal line 61. Further, a common voltage VCOM is supplied from the common voltage generation circuit 50 to the pixel parts 100 through a common voltage line 51.

The pixel parts 100 comprises an XY calculating circuit 110 connected to the X signal line 31 and the Y signal line 41, a signal comparator 120 connected to the XY calculating circuit 110, a switch 130 controlled according to the output of the signal comparator, a pixel electrode 140 of which the connection with a liquid crystal drive signal line 61 is controlled by a switch 130, and liquid crystal 150 arranged between the pixel electrode 140 and the common voltage line 51. As shown in FIG. 1, the pixel parts 100 is divided into a block 160 having 16 pixel parts of 4 columns in an X direction and 4 rows in a Y direction in total.

Figure 3:
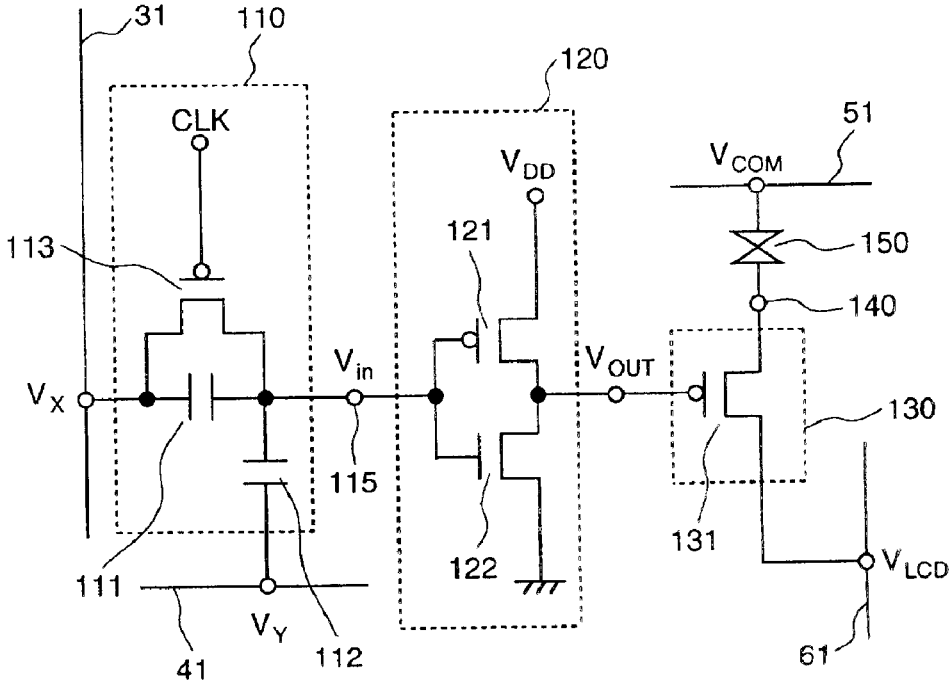
FIG. 3 shows one example of detailed circuit structure of pixel parts 100 of FIG. 2.

FIG. 3 shows one example of a detailed circuit structure of the pixel parts 100. The XY calculating circuit 110 comprises a capacitor 111 connected to the terminal where VX is supplied from the X signal line 31, a capacitor 112 connected to the terminal where VY is supplied from the Y signal line 41, and a p-type MOS-TFT 113 which operates according to a clock pulse CLK. The clock pulse CLK is supplied from the Y driver 40 through a clock pulse line 71. The signal comparator 120 comprises a p-type MOS-TFT 121 and n-type MOS-TFT 122 connected in series. The switch 130 comprises a p-type MOS-TFT 131. A source terminal of the p-type MOS-TFT 131 is connected to the pixel electrode 140, and its drain terminal is connected to the liquid crystal drive signal line 61.

The capacity of the capacitor 111 and that of the capacitor 112 of the XY calculating circuit 110 is equal, and the input voltage Vin=(VX+VY)/2 of the signal comparators 120 is output. The output of a terminal 115 of the XY calculating circuit 110, that is, the input terminal of the signal comparator 120 is in a floating state. Therefore, the output terminal 115 and X signal line 31 are sometimes caused to be in an on-state through the p-type MOS-TFT 113 to stabilize the operation of the circuit.

Figure 4:
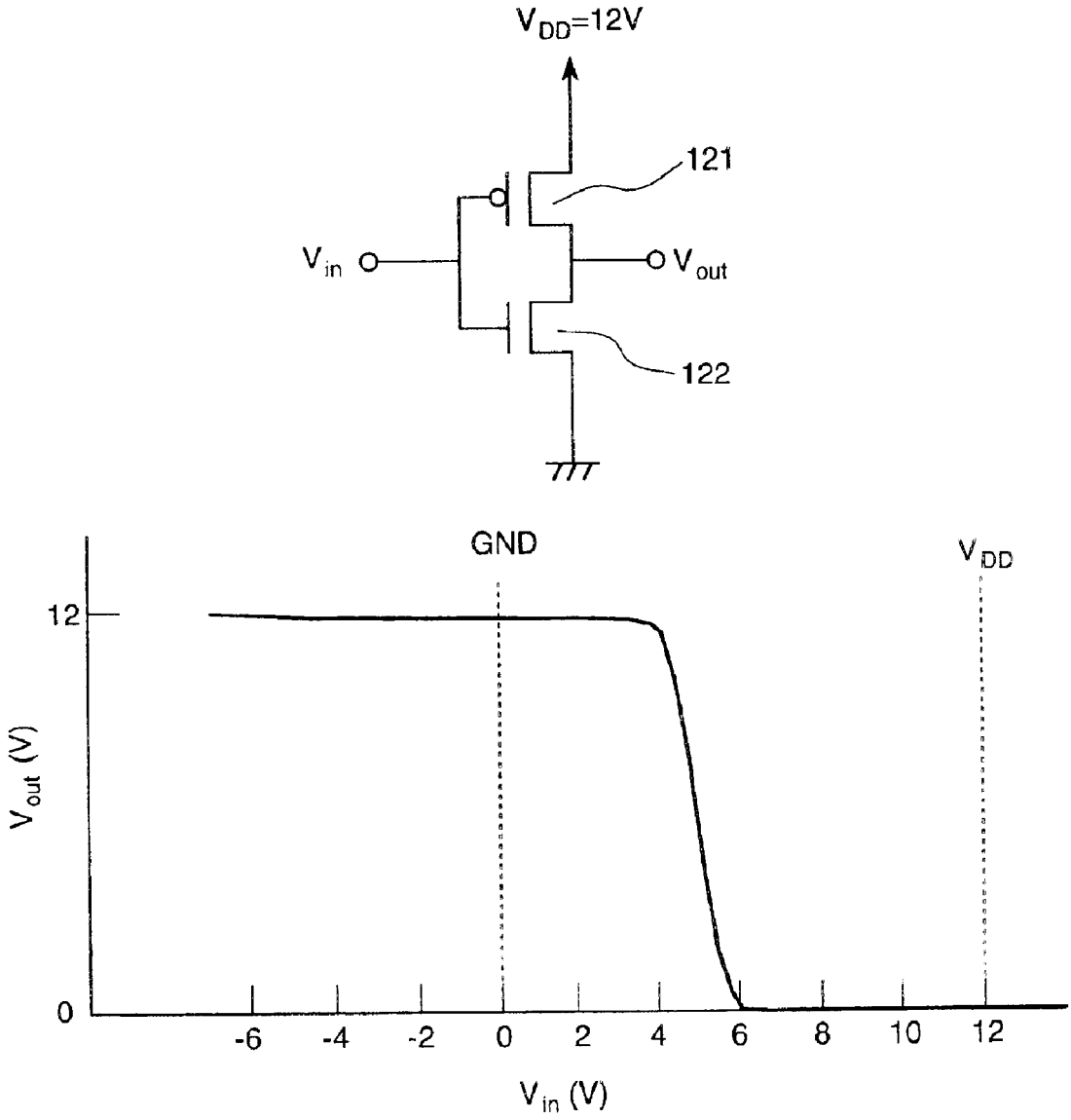
FIG. 4 is a view illustrating the operation of the signal comparator of FIG. 3.

FIG. 4 is a view illustrating the operation of the signal comparator 120. When VDD is assumed to be 12V, the relationship between the input Vin of signal comparator 120 and the output Vout is as shown in FIG. 4. That is, Vout=12V when Vin is 4V or less and Vout=0V when Vin is 6V or more. For the sake of simplicity of explanation, the signal line for supplying VDD and the signal line for supplying the earth voltage are omitted in FIGS. 1 and 2.

The operation of this embodiment 1 will be explained next. The picture signal with gradation information on each pixel is input to the n-gradation approximation calculating circuit 10, in which the pixels are divided into blocks in every four line×four columns=16, and the gradation of the pixel is approximated to binary in every block 16.

The approximation calculation is carried out as follows. First of all, the mean value of the gradation of 16 pixels is calculated. Next, the pixel in the block is divided into high pixels H and low pixels L according to the mean value of the gradation level. The mean value of the gradation of pixel H is calculated, and the obtained mean value is approximated with the gradation value of pixel H. Similarly, the mean value of the gradation of pixel L is calculated, and the obtained mean value is approximated with the gradation value of pixel L. Further, the pixel in the block is examined in a Y direction. For example, when their pixels are arranged in the order of pixel H, pixel H, pixel L, and pixel H, etc., their pixels are approximated to become two areas of pixel H and pixel L, or only pixel H or only pixel L along the Y direction, by reordering their pixels like pixel H, pixel H, pixel H, and pixel L, etc. These two gradation values are sequentially defined in the Y direction as a first gradation value and a second gradation value. The n-gradation approximation picture signals generated by executing the above-mentioned approximation for all blocks, are input to the signal generation circuit 20.

The signal generation circuit 20 generates the signal for controlling the output voltages of the X driver, the Y driver, the signal supply circuit, and the common voltage generating circuit according to the n-gradation approximation picture signal.

FIG. 5 is a view illustrating the control operation of the display system of FIG. 1. The 64 pixels in total formed by eight columns in the X direction, and eight rows in the Y direction are shown in FIG. 5. Here, four rows×four columns=16 pixels are assumed to be one block. The columns are defined as a first column, a second column, . . . from the left in an X direction. The rows are defined as a first row, a second row, . . . from the left in an X direction.

First of all, for selection period t1, the voltage of 20V is applied to Y signal line of the first row to fourth row, and 0V is applied to other Y signal lines. The output voltage (Vin) of the XY calculating circuit of the pixel is shown in each mass of FIG. 5. Vin=(VX+VY)/2 as shown in the above-mentioned. In the example of FIG. 5, VX=4V is applied to the first column, and VY=20V is applied to the first row. Therefore, Vin=(4+20)/2=12V. The voltage applied as VX is either −8, −4, 0, 4 or 8V. Vin is 6V or more without fail if VY=20. Because the signal comparator 120 has the characteristic shown in FIG. 3, Vout in this case is 0V regardless of VX. Therefore, the p-type MOS-TFT 131 of the switch 130 is in an on-state, and the liquid crystal drive voltage VLCD is written in the pixel electrode 140.

That is, VLCD corresponding to the first gradation value is written in the pixel electrode of all pixels of the first row to fourth row for the period of t1. Here, VLCD of other blocks has a different voltage value although VLCD of the same block is the same. That is, the first gradation value is different in every block.

On the other hand, because VY of the fifth row to eighth row is 0V, the value of Vin is 4V or less regardless of the value of VX. Because the signal comparator 120 has the characteristic shown in FIG. 3, Vout in this case is 12V regardless of VX. Therefore, the p-type MOS-TFT 131 of the switch 130 is in an off-state, and the voltage of pixel electrode 140 is held without changing.

Next, VY of the first block group becomes 4, 8, 12, and 16V in order from the top for the selection period of t2, and VY of the second block group becomes 20V. VY of other lines is all 0V although not shown in FIG. 5. The voltage corresponding to the n-gradation approximation picture signal is applied to the X signal line 31.

That is, VX=4V is applied to the column where the pixels of the first row has the first gradation value, and the pixels of the second row to fourth row has the second gradation value. VX=0V is applied to the column where the pixels of the first row to second row has the first gradation value, and the pixels of the third row to fourth row has the second gradation value. VX=−4V is applied to the column where the pixels of the first row to third row has the first gradation value, and the pixel of a fourth row has the second gradation value. VX=−8V is applied to the column where all pixels of the first row to fourth row have the first gradation value. VX=8V is applied to the column where all pixels of the first row to fourth row have the second gradation value.

The first column of FIG. 5(*b*) shows the state in which the n-gradation approximation signal has been sent, where the pixels of the first row to second row have the first gradation value, and the pixels of the third row to fourth row have the second gradation value. Therefore, VX of the first column is 0V. The mass that section lines are done in FIG. 5 shows a pixel where the liquid crystal drive voltage is written in pixel electrode for this period. In this embodiment 1, the second gradation value of the blocks corresponding to the first row to fourth row becomes the same value as the first gradation value of the blocks corresponding to the fifth row to eighth row.

As mentioned above, liquid crystal drive voltage which corresponds to the first gradation value is first written in all pixel electrodes in the block corresponding to the first row to fourth row for the first period. Next, for the second period, the liquid crystal drive voltage which corresponds to the n-gradation approximation picture signal generated by the n-gradation approximation signal calculating circuit can be written in the pixel electrodes of the pixels in the block by rewriting only the pixel electrode of the pixel which becomes the second gradation value in liquid crystal drive voltage corresponding to the second gradation value.

The p-type MOS-TFT of the switch is in an off-state while the liquid crystal drive voltage is written in the blocks of other lines. Therefore, the written liquid crystal drive voltage is held until the block is selected again. The liquid crystal drive voltage which corresponds to the n-gradation approximation signal is written in the pixel electrodes of all blocks by repeating the above-mentioned operation one by one.

Figure 6:
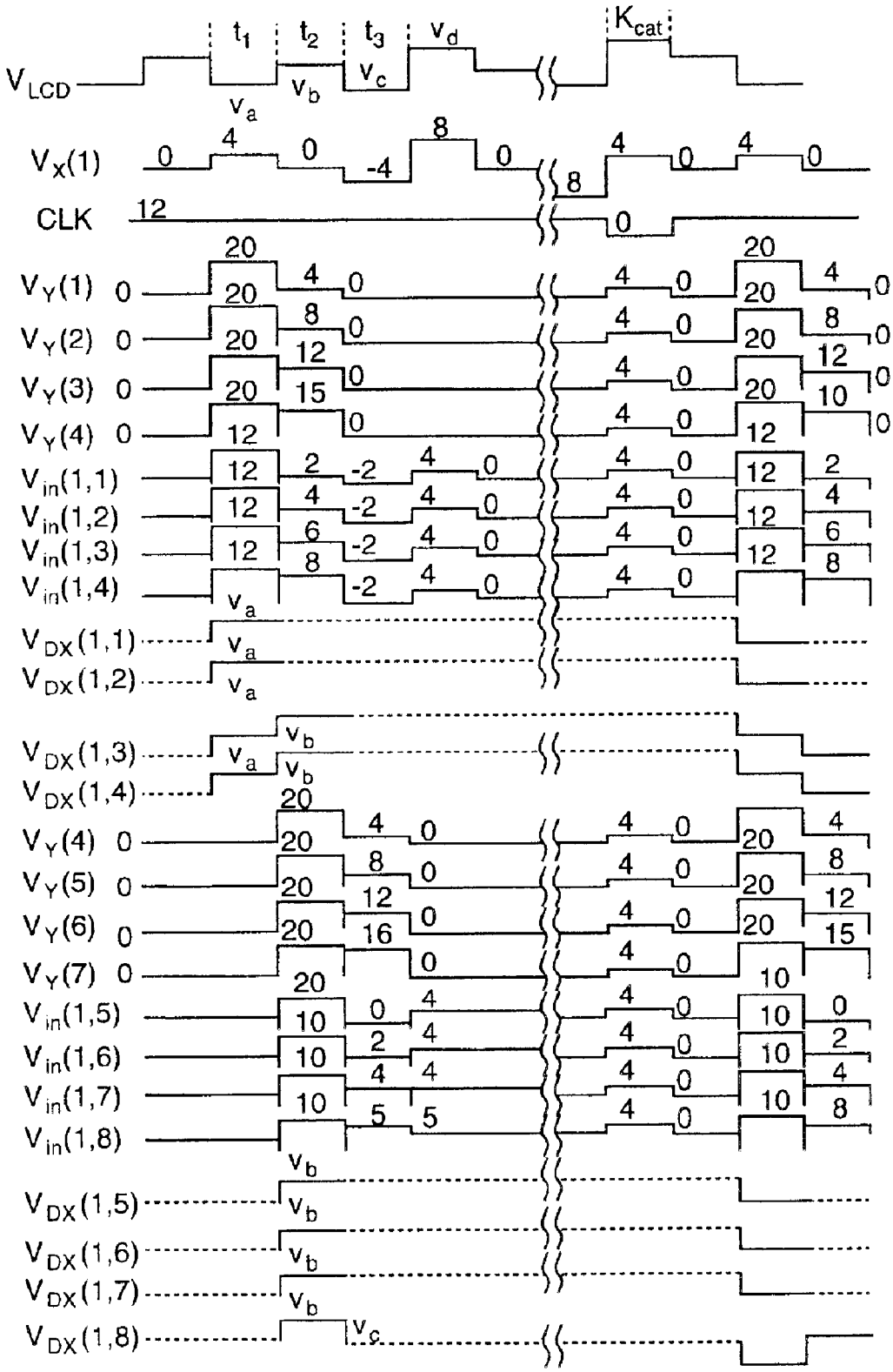
FIG. 6 is a timing chart illustrating the control operation of the display system of FIG. 1.

FIG. 6 is a timing chart illustrating the control operation of the display system of FIG. 1. VLCD is the liquid crystal drive voltage common to the block corresponding to the first column to fourth column. CLK is a clock pulse of the XY calculating circuit. VY(1) to VY(8) are the voltages VY of Y signal line 41 of the first row to the eighth row respectively. Vin(1,1) to Vin(1,8) are input voltages Vin of the signal comparator 120 of the pixels of the first column, the first row to the first column, the first row, respectively. VPX(1,1) to VPX(1,8) are voltages of pixel electrodes 140 of the pixels of the first column, the first row to the first column, the eighth row, respectively. In VPX(1,1) to VPX (1,8), a broken line shows the state that the p-type MOS-TFT 13 is in an off-state and the voltage of the pixel electrode is held.

VLCD=Va, VX(1)=4V and CLK=12V for the selection period of t1. Because Y(1) to VY(4)=20V, Vin(1,1) to Vin(1,4)=(4+20)/2=12V, that is, all are 6V or more. Therefore, the p-type MOS-TFT 131 becomes an on-state, and the liquid crystal drive voltage VLCD=Va is written in the pixel electrode 140, and thus VPX(1,1)=VPX(1,2)=VPX (1,3)=VPX(1,4)=Va. Because VY(5) to VY(8)=0V, Vin(1,5) to Vin(1,8)=(4+0)/2=2V. That is, all are 4V or less. Therefore, the p-type MOS-TFT 131 becomes an off-state, and the potential VPX(1,5) to VPX(1,8) of the pixel electrodes 140 are held without changing.

VLCD=Vb, VX(1)=0V and CLK=12V for the next selection period of t2. Because VY(1)=4V, VY(2)=8V, VY(3)=12V, and VY(4)=16V, Vin(1,1)=2V, Vin(1,2)=4V, Vin (1,3)=6V, and Vin(1,4)=8V from Vin=(V X+VY)/2. The p-type MOS-TFT 131 of the pixels of which Vin is 6V or more becomes an on-state, and The liquid crystal drive voltage VLCD=Vb is written in the pixel electrode 140. As a result, VPX(1,3)=VPX(1,4)=Vb.

The p-type MOS-TFT 131 of the pixels of which Vin is 4V or less becomes an off-state, and The liquid crystal drive voltage Va written during the period of t1 is held in the pixel electrode 140. As a result, VPX(1,1)=VPX(1,2)=Va. Because VY(5) to VY(8)=20V, Vin(1,5) to Vin(1,8)=(0+20)/2=10V. That is, all is 6V or more. The p-type MOS-TFT 131 becomes an on-state. As a result, the liquid crystal drive voltage VLCD=Vb is written in pixel electrode 140. As a result, VPX(1,5)=VPX(1,6)=VPX(1,7)=VPX(1,8)=Vb.

VLCD=Vc, VX(1)=−4V and CLK=12V for the next selection period of t3. Because VY(1)=VY(2)=VY(3)=VY (4)=0V, Vin(1,1)=Vin(1,2)=Vin (1,3)=Vin(1,4)=−2V from Vin=(VX+VY)/2. Because Vin is 4V or less, the p-type MOS-TFT 131 of the pixels becomes an off-state, and the liquid crystal drive voltage of the pixel electrode 140 is held. As a result, VPX(1,1)=VPX(1,2)=Va, VPX(1,3)=VPX(1,4)=Vb. Because VY(5)=4V, VY(6)=8V, VY(7)=12V, VY(8)=16V; Vin(1,5)=0V, Vin(1,6)=2V, Vin(1,7)=4V, Vin(1,8)=6V from Vin=(VX+VY)/2.

The p-type MOS-TFT 131 of the pixels of which Vin is 6V or more becomes an on-state, and The liquid crystal drive voltage VLCD=Vb is written in the pixel electrode 140. As a result, VPX(1,8)=Vc. The p-type MOS-TFT 131 of the pixels of which Vin is 4V or less becomes an off-state, and The liquid crystal drive voltage Vb written during the period of t2 is held in the pixel electrode 140. As a result, VPX(1, 5)=VPX(1,6)=VPX(1,7)=VPX(1,8)=Vb.

By repeating the above operation, the liquid crystal drive voltage VLCD corresponding to the n-gradation approximation picture signal generated by the n-gradation approximation calculating circuit 10 is written in pixel electrode 140 of the pixels of the blocks of the ninth row to twelveth row and the thirteenth row to sixteenth row one by one.

After writing all pixel electrode is finished, the reset period is set. Because the output terminal of the XY calculating circuit is reset for this period, the stable operation is secured. All are set in VX=VY=4V, and CLK=0V for the reset period. At this time, the p-type MOS-TFT 113 becomes an on-state, and the voltage of the output terminal becomes 4 v equal to VX and VY. Even if an unnecessary electric charge is held in the floating output terminal, it is possible to cancel. Therefore, the stable operation can be obtained.

The above-mentioned operation is ended in the period of one frame, and the picture is displayed by repeating this frame period.

It is possible to write the liquid crystal drive voltage in the pixels of one block formed by four rows in two selection period. Therefore, the frequency of the selection period can be adjusted to half, compared with the prior art in which four rows is written in four selection period.

The length of the selection period can be doubled by using this embodiment 1 when one frame period is the same. Further, the second selection period and the first selection period of the block formed with the next four rows are the same for this embodiment 1. Therefore, the selection period doubles further, and thus the selection time of quadruple in total can be secured. This means that it is possible to display the quadruple number of rows compared with prior art, in case of the case with the same signal electrode as prior art.

[Embodiment 2]

Figure 7:
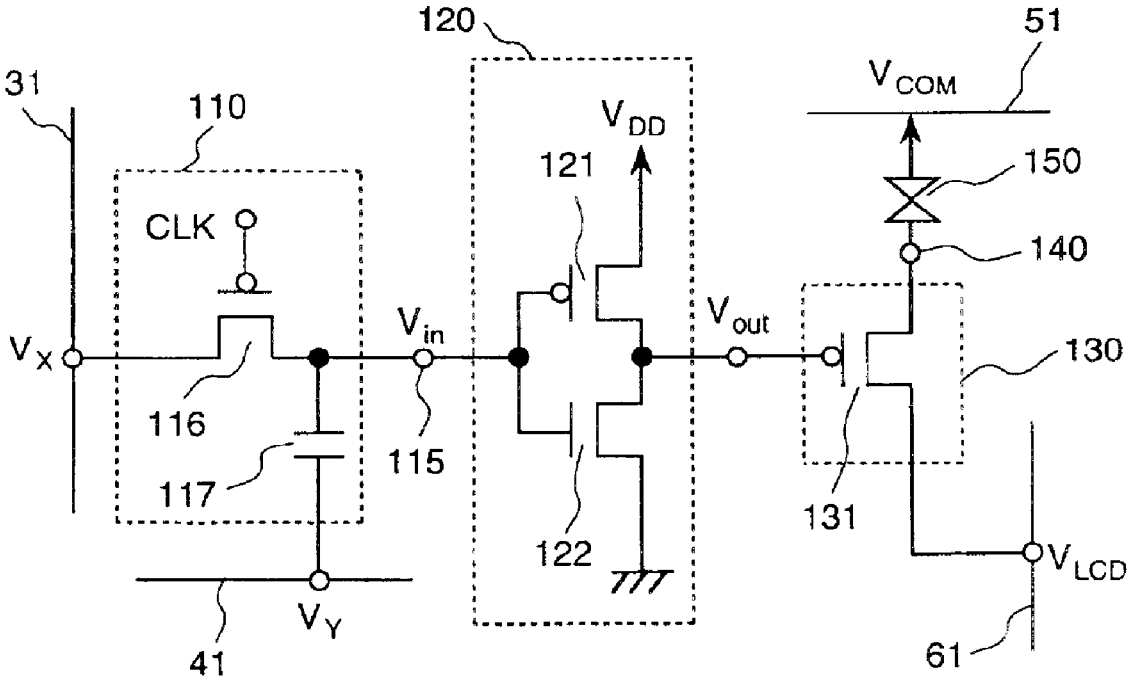
FIG. 7 shows a detailed circuit structure of pixel parts 100 in embodiment 2 of the display system according to the present invention.

FIG. 7 shows a detailed circuit structure of pixel parts 100 in embodiment 2 of the display system according to the present invention. The configuration of XY calculating circuit 110 differs from that shown in FIG. 3 in the embodiment 1 although the whole configuration of display system is the same as FIG. 1. The XY calculating circuit 110 in this embodiment 2 comprises a p-type MOS-TFT 116 and a capacitor 117. A drain terminal of the p-type MOS-TFT 116 is connected to the X signal line 31, and its source terminal is connected to one terminal of the capacitor 117. The other terminal of capacitor 117 is connected to Y signal line 41.

The operation of the XY calculating circuit 110 shown in FIG. 7 will be explained next. First, CLK is set to be at low level (4V) while assumed VY=10V for the first selection period, and the p-type MOS-TFT 116 is caused to become an on-state. As a result, the voltage VX of the X signal line is written in the output terminal 115 of the XY calculating circuit 110 or the the input terminal of the signal comparator. After CLK is made to be a high level (16V) for the second selection period, and thus the p-type MOS-TFT 116 is put into an off-state, the voltage of VY is changed. Assuming that the change in the voltage at this time is ΔVY, the voltage of the output terminal 115 becomes VX+ΔVY for the voltage VX written for the first selection period. That is, the results of VX and VY is output to the output terminal 115.

The picture signal with gradation information on each pixel is input to the n-gradation approximation calculating circuit 110, in which the pixels are divided into blocks in every four line×four columns=16, and the n-gradation approximation picture signals is generated by approximating the gradation of the pixel to binary in every block 16. The approximation is performed in a way similar to the embodiment 1. The signal generation circuit 20 generates the signal for controlling the output voltages of the X driver, the Y driver, the signal supply circuit, and the common voltage generating circuit according to the n-gradation approximation picture signal.

FIG. 8 is a view illustrating the control operation of the display system of FIG. 7. The 64 pixels in total formed by eight columns in the X direction, and eight rows in the Y direction are shown in FIG. 8. Here, four rows×four columns=16 pixels are assumed to be one block. The columns are defined as a first column, a second column, . . . from the left in an X direction. The rows are defined as a first row, a second row, . . . from the left in an X direction.

First of all, for selection period t1, the voltage of 10V is applied to Y signal line of the first row to fourth row, and 0V is applied to other Y signal lines. The output voltage (Vin) of the XY calculating circuit of the pixel is shown in each mass of FIG. 8. For the selection period of t1, CLK of the XY calculating circuits of the first row to fourth row is at low level (4V), and the p-type MOS-TFT 116 is in an on-state. Therefore, Vin of the pixels of the first row to fourth row is equal to VX. In the example of FIG. 8, VX=10V is applied to the first column, and VY=10V is applied to the first row. Therefore, Vin(1,1)=VX(1)=10V. The voltage according to the n-gradation approximation picture signal of the block formed by the pixels of the first row to fourth row is applied to the X signal line 31.

That is, VX=12V is applied to the column where the pixels of the first row has the first gradation value, and the pixels of the second row to fourth row has the second gradation value. VX=10V is applied to the column where the pixels of the first row to second row has the first gradation value, and the pixels of the third row to fourth row has the second gradation value. VX=8V is applied to the column where the pixels of the first row to third row has the first gradation value, and the pixel of a fourth row has the second gradation value. VX=6V is applied to the column where all pixels of the first row to fourth row have the first gradation value. VX=14V is applied to the column where all pixels of the first row to fourth row have the second gradation value.

As mentioned above, the voltage applied as VX is either 6, 8, 10, 12 or 14V. Therefore, Vin=VX of the pixels of the first row to fourth row for the selection period of t1 when the p-type MOS-TFT 116 exists in an on-state is 6V or more without fail.

Because signal comparator 120 has the characteristic shown in FIG. 3, Vout in this case is 0V regardless of VX. Therefore, the p-type MOS-TFT 131 of the switch 130 is in an on-state, and the liquid crystal drive voltage VLCD is written in the pixel electrode 140. That is, VLCD corresponding to the first gradation value is written in the pixel electrodes of all pixels of the first row to fourth row for the period of t1. Here, VLCD of other blocks has a different voltage value though VLCD of the same block is the same. That is, the first gradation value is different in every block.

On the other hand, because VY of the fifth row to eighth row is 0V, and the p-type MOS-TFT 116 is in an off-state, the value of Vin is 4V or less regardless of the value of VX. Because the signal comparator 120 has the characteristic shown in FIG. 3, Vout in this case is 12V regardless of VX. Therefore, the p-type MOS-TFT 131 of the switch 130 is in an off-state, and the voltage of pixel electrode 140 is held without changing.

Next, VY of the first row to fourth row becomes 4, 8, 12, and 16V in order from the top for the selection period of t2, and VY of the fifth row to eighth row becomes 20V. VY of other lines is all 0V although not shown in FIG. 5. The voltage corresponding to the n-gradation approximation picture signal is applied to the X signal line 31.

That is, VX=12V is applied to the column where the pixels of the first row has the first gradation value, and the pixels of the second row to fourth row has the second gradation value. VX=10V is applied to the column where the pixels of the first row to second row has the first gradation value, and the pixels of the third row to fourth row has the second gradation value. VX=8V is applied to the column where the pixels of the first row to third row has the first gradation value, and the pixel of a fourth row has the second gradation value. VX=6V is applied to the column where all pixels of the first row to fourth row have the first gradation value. VX=14V is applied to the column where all pixels of the first row to fourth row have the second gradation value.

As mentioned above, Vin of the first row to fourth row becomes the sum of VX(t1) which is VX for the selection period of t1, and difference ΔVY=VY(t2)−VY(t1) of Vx(t1) which is VX for the selection period of t1 and VY(t2) which is VY for the selection period of t2. That is, Vin(t2)=VX(t1)+VY(t2)−VY(t1)=VX(t1)+VY(t2)−10.

The first column of FIG. 8(*b*) shows the state in which the n-gradation approximation signal has been sent, where the pixels of the first row to second row have the first gradation value, and the pixels of the third row to fourth row have the second gradation value. Therefore, V(t1) of the first column is 0V. Vin=VX because CLK of the XY calculating circuit 110 of the pixels of the fifth row to eighth row is in low level (4V), and the p-type MOS-TFT 116 is in an on-state. The voltage applied as VX is either 6, 8, 10, 12 or 14V. Therefore, Vin=VX of the pixels of the first row to fourth row for the selection period of t1 when p-type MOS-TFT 116 is in an on-state is 6V or more without fail.

Because signal comparator 120 has the characteristic shown in FIG. 3, Vout in this case is 0V regardless of VX. Therefore, the p-type MOS-TFT 131 of the switch 130 is in an on-state, and the liquid crystal drive voltage VLCD is written in the pixel electrode 140. That is, VLCD corresponding to the second gradation value of the block of the first row to fourth row is written in the pixel electrodes of all pixels of the fifth row to eighth row for the period of t2.

The mass where section lines are done in FIG. 5 shows a pixel where the liquid crystal drive voltage is written in pixel electrode for this period. In this embodiment, the second gradation value of the block corresponding to the first row to fourth row becomes the same value as the first gradation value of the block corresponding to the fifth row to eighth row. As mentioned above, the liquid crystal drive voltage which corresponds to the first gradation value of the block corresponding to the first row to fourth row is written in all pixel electrodes of the block corresponding to the first row to fourth row for the selection period of t1.

For the following selection period of t2, the liquid crystal drive voltage corresponding to the second gradation value of the block of the first row to fourth row is written in all the pixel electrodes of the fifth row to eighth row at the same time as rewriting the voltage of pixel electrode of the pixel which becomes the second gradation value of the block corresponding to the first row to fourth row in the liquid crystal drive voltage corresponding to the second gradation value.

By repeating the above operation, the liquid crystal drive voltage which corresponds to the n-gradation approximation picture signal generated by the n-gradation approximation signal calculating circuit can be written in the pixel electrodes of the pixels in the block. The p-type MOS-TFT of the switch is in an off-state while the liquid crystal drive voltage is written in the blocks of other lines. Therefore, the written liquid crystal drive voltage is held until the block is selected again. The liquid crystal drive voltage which corresponds to the n-gradation approximation signal is written in the pixel electrodes of all blocks by repeating the above-mentioned operation one by one.

Figure 9:
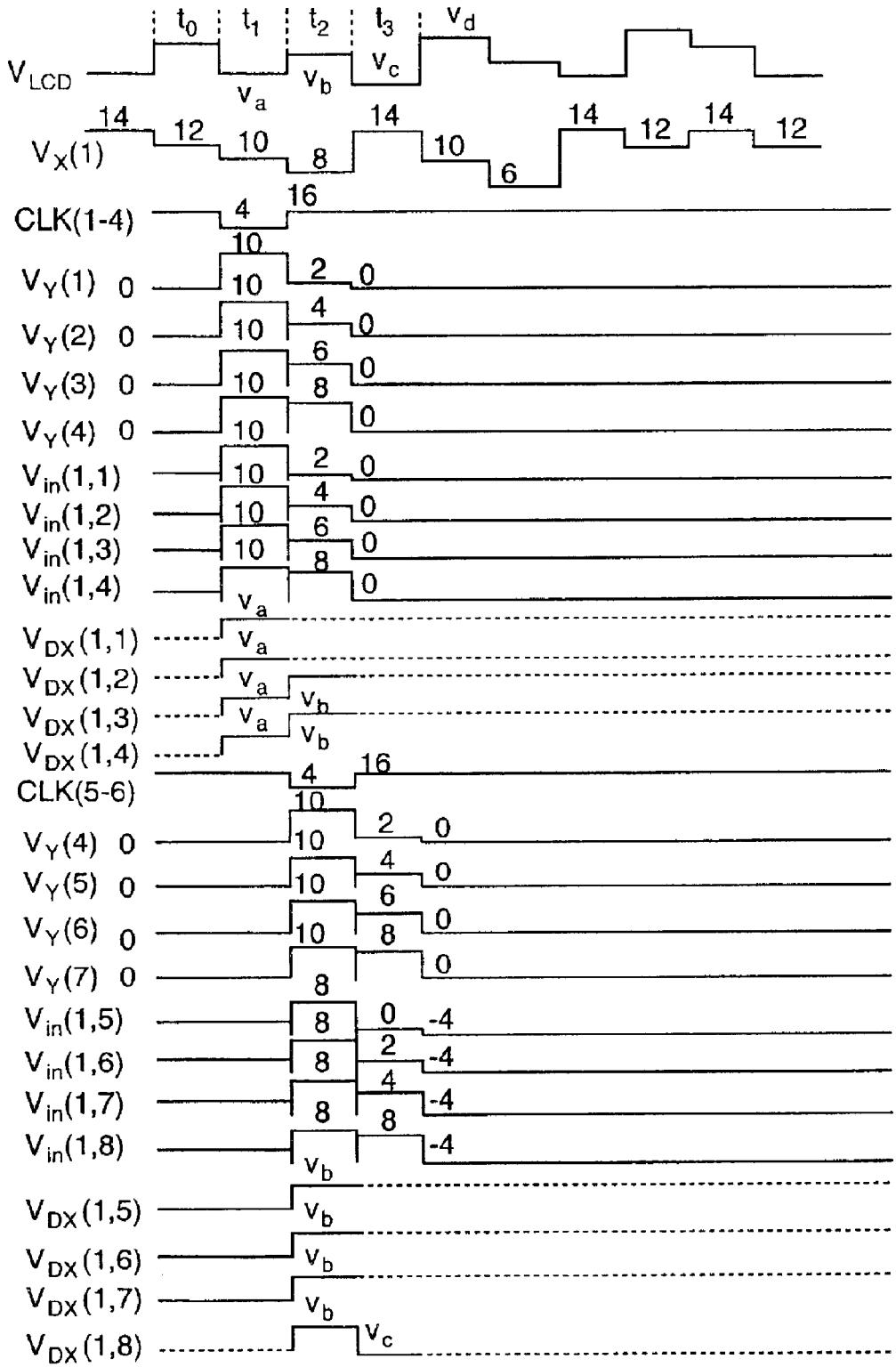
FIG. 9 is a timing chart illustrating the control operation of the display system of FIG. 7.

FIG. 9 is a timing chart illustrating the control operation of the display system of FIG. 7. VLCD is the liquid crystal drive voltage common to the block corresponding to the first column to fourth column. CLK(1–4) are clock pulses of the XY calculating circuits of the first row to fourth row. CLK(5–8) are clock pulses of the XY calculating circuits of the fifth row to eighth row. VY(1) to VY(8) are the voltages VY of Y signal line 41 of the first row to the eighth row, respectively. Vin(1,1) to Vin(1,8) are input voltages Vin of the signal comparator 120 of the pixels of the first column, the first row to the first column, the eighth row, respectively. VPX(1,1) to VPX(1,8) are voltages of pixel electrodes 140 of the pixels of the first column, the first row to the first column, the eighth row, respectively. In VPX(1,1) to VPX (1,8), a broken line shows the state that the p-type MOS-TFT 13 is in an off-state and the voltage of the pixel electrode is held.

For the selection period of t1, VLCD=Va, VX(1)=10V, CLK(1–4)=4V, CLK(5–8)=16V, and VY(1) to VY(4)=10V. Because, CLK(1–4)=4V, the p-type MOS-TFT 116 is in an on-state, and Vin(1,1) to Vin(1,4)=VX(1)=10V. Therefore, all is six V or more, and the p-type MOS-TFT 131 becomes an on-state. As a result, the liquid crystal drive voltage VLCD=Va is written in the pixel electrode 140, and thus VPX(1,1)=VPX(1,2)=VPX(1,3)=VPX(1,4)=Va. Because CLK(5–8)=16V, VY(5) to VY(8)=0V, Vin(1,5) to Vin(1,8) is held at the voltage of 4V or less written before. Therefore, the p-type MOS-TFT 131 is an off-state, and the potential VPX(1,5) to VPX(1,8) of the pixel electrodes 140 are held without changing.

VLCD=Vb, VX(1)=8V, CLK(1–4)=16V, and CLK(5–8)=4V for the next selection period of t2. Because VY(1)=2V, VY(2)=4V, VY(3)=6V, and VY(4)=8V; Vin(1,1)=2V, Vin(1, 2)=4V, Vin (1,3)=6V, and Vin(1,4)=8V from Vin(t2)=(VX (t1)+VY(t2)−10). The p-type MOS-TFT 131 of the pixels of which Vin is 6V or more becomes an on-state, and The liquid crystal drive voltage VLCD=Vb is written in the pixel electrode 140. As a result, VPX(1,3)=VPX(1,4)=Vb.

The p-type MOS-TFT 131 of the pixels of which Vin is 4V or less becomes an off-state, and The liquid crystal drive voltage Va written during the period of t1 is held in the pixel electrode 140. As a result, VPX(1,1)=VPX(1,2)=Va. Because CLK(5–8)=4V, and VY(5) to VY(8)=10V; Vin(1,5) to Vin(1,8)=VX=8V. That is, all is 6V or more. The p-type MOS-TFT 131 becomes an on-state. As a result, the liquid crystal drive voltage VLCD=Vb is written in pixel electrode 140. As a result, VPX(1,5)=VPX(1,6)=VPX(1,7)=VPX(1, 8)=Vb.

VLCD=Vc, VX(1)=14V and CLK(1–4)=CLK(5–8)=16V for the next selection period of t3. Because VY changes to VY(1)=VY(2)=VY(3)=VY(4)=0V, Vin(1,1)=Vin(1,2)=Vin (1,3)=Vin(1,4)=0V from Vin=(VX(t1)+VY(t3)−VY(t1))=(VX(t1)−10). Because Vin is 4V or less, the p-type MOS-TFT 131 of the pixels becomes an off-state, and the liquid crystal drive voltage of the pixel electrode 140 is held. As a result, VPX(1,1)=VPX(1,2)=Va, VPX(1,3)=VPX(1,4)=Vb. Because VY(5)=2V, VY(6)=4V, VY(7)=6V, VY(8)=8V; Vin (1,5)=0V, Vin(1,6)=2V,Vin(1,7)=4V, Vin(1,8)=6V from Vin (t3)=(VX(t2)+VY(t2)−VY(t3))=(VX(t2)+VY(t2)−10). The p-type MOS-TFT 131 of the pixels of which Vin is 6V or more becomes an on-state, and The liquid crystal drive voltage VLCD=Vb is written in the pixel electrode 140. As a result, VPX(1,8)=Vc. The p-type MOS-TFT 131 of the pixels of which Vin is 4V or less becomes an off-state, and The liquid crystal drive voltage Vb written during the period of t2 is held in the pixel electrode 140. As a result, VPX(1, 5)=VPX(1,6)=VPX(1,7)=VPX(1,8)=Vb.

By repeating the above operation, the liquid crystal drive voltage VLCD corresponding to the n-gradation approximation picture signal generated by the n-gradation approximation calculating circuit 10 is written in pixel electrode 140 of the pixels of the block of the ninth row to twelveth row, the block of the thirteenth row to sixteenth row, etc. one by one.

The above-mentioned operation is ended in the period of one frame, and the picture is displayed by repeating this frame period. It is possible to write the liquid crystal drive voltage in the pixels of one block formed by four rows in two selection period. Therefore, the frequency of the selection period can be adjusted to half, compared with the prior art in which four rows is written in four selection period. The length of the selection period can be doubled by using this embodiment 2 when one frame period is the same.

Further, in this embodiment 2, the second selection period and the first selection period of the block formed with the next four rows are the same. Therefore, the selection period doubles further, and thus the selection time of quadruple in total can be secured. This means that it is possible to display the quadruple number of rows compared with prior art, in case of the case with the same signal electrode as prior art.

In this embodiment 2, when writing, the p-type MOS-TFT of the XY calculating circuit becomes an on-state, and the output terminal of the XY calculating circuit is connected to the X signal line 31. Therefore, the mechanism to cancel the floating potential used in embodiment 1 is unnecessary.

Further, the voltage values of VX and VY to generate the voltage value of same result Vin becomes a small value. Therefore, it becomes possible to use the X driver and the Y driver of a low withstand voltage.

[Embodiment 3]

The whole configuration of embodiment 3 of the present invention is the same as that of FIG. 1. Further, the detailed circuit structure of the pixel parts is the same as that in embodiment 2 shown in FIG. 7.

The second gradation value of the block corresponding to the first row to fourth row in the embodiment 2 is equal to the first gradation value of the block corresponding to the fifth row to eighth row. However, the first gradation value of the second gradation value of the block corresponding to the first row to fourth row and the block corresponding to the fifth row to eighth row can be adjusted to a different value in the embodiment 3. Therefore, because the number of the gradation values used for the approximation is doubled compared with the embodiment 2, the original picture can be reproduced with a high accuracy.

The operation of the embodiment 3 according to the present invention will be explained in detail. The picture signal with gradation information on each pixel is input to the n-gradation approximation calculating circuit 10 shown in FIG. 1, in which the pixels are divided into blocks in every four rows×four columns=16, and the n-gradation approximation picture signals is generated by approximating the gradation of the pixel to binary in every block 16. The approximation is performed in a way similar to the embodiment 1. The signal generation circuit 20 generates the signal for controlling the output voltages of the X driver, the Y driver, the signal supply circuit, and the common voltage generating circuit according to the n-gradation approximation picture signal.

FIG. 10 is a view illustrating the control operation of the display system of the embodiment 3. The 64 pixels in total formed by eight columns in the X direction, and eight rows in the Y direction are shown in FIG. 10. Here, four rows× four columns=16 pixels are assumed to be one block. The columns are defined as a first column, a second column, . . . from the left in an X direction. The rows are defined as a first row, a second row, . . . from the left in an X direction.

First of all, for selection period t1, the voltage of 10V is applied to Y signal line of the first row to fourth row, and 0V is applied to other Y signal lines. The output voltage (Vin) of the XY calculating circuit of the pixel is shown in each mass of FIG. 10. CLK of the XY calculating circuits of the first row to fourth row is at low level (4V), and the p-type MOS-TFT 116 shown in FIG. 7 is in an on-state. Therefore, Vin of the pixels of the first row to fourth row is equal to VX.

In the example of FIG. 10, VX=10V is applied to the first column, and VY=10V is applied to the first row. Therefore, Vin(1,1)=VX(1)=10V. The voltage according to the n-gradation approximation picture signal of the block formed by the pixels of the first row to fourth row is applied to the X signal line 31.

That is, VX=12V is applied to the column where the pixels of the first row has the first gradation value, and the pixels of the second row to fourth row has the second gradation value. VX=10V is applied to the column where the pixels of the first row to second row has the first gradation value, and the pixels of the third row to fourth row has the second gradation value. VX=8V is applied to the column where the pixels of the first row to third row has the first gradation value, and the pixel of a fourth row has the second gradation value. VX=6V is applied to the column where all pixels of the first row to fourth row have the first gradation value. VX=14V is applied to the column where all pixels of the first row to fourth row have the second gradation value.

As mentioned above, the voltage applied as VX is either 6, 8, 10, 12 or 14V. Therefore, Vin=VX of the pixels of the first row to fourth row for the selection period of t1 when the p-type MOS-TFT 116 exists in an on-state is 6V or more without fail. Because signal comparator 120 has the characteristic shown in FIG. 3, Vout in this case is 0V regardless of VX. Therefore, the p-type MOS-TFT 131 of the switch 130 is in an on-state, and the liquid crystal drive voltage VLCD is written in the pixel electrode 140. That is, VLCD corresponding to the first gradation value is written in the pixel electrodes of all pixels of the first row to fourth row for the period of t1. Here, VLCD of other blocks has a different voltage value though VLCD of the same block is the same. That is, the first gradation value is different in every block.

On the other hand, because VY of the fifth row to eighth row is 0V, and the p-type MOS-TFT 116 is in an off-state, the value of Vin is 4V or less regardless of the value of VX. Because the signal comparator 120 has the characteristic shown in FIG. 3, Vout in this case is 12V regardless of VX. Therefore, the p-type MOS-TFT 131 of the switch 130 is in an off-state, and the voltage of pixel electrode 140 is held without changing.

Next, for the selection period of t2, VY of the first row to fourth row becomes 2, 4, 6, and 8V in order from the top, and VY of the fifth row to eighth row is held at 10V. VY of other lines is all 0V although not shown in FIG. 10. Further, CLK of the first row to fourth row becomes a high level (16V), and the p-type MOS-TFT 116 becomes an off-state. As mentioned above, Vin of the first row to fourth row becomes the sum of VX(t1) which is VX for the selection period of t1, and difference ΔVY=VY(t2)−VY(t1) of VX(t1) which is VX for the selection period of t1 and VY(t2) which is VY for the selection period of t2. That is, Vin(t2)=VX(t1)+VY(t2)−VY(t1)=VX(t1)+VY(t2)−10.

The first column of FIG. 10(*b*) shows the state in which the n-gradation approximation signal has been sent, where the pixels of the first row to second row have the first gradation value, and the pixels of the third row to fourth row have the second gradation value. Therefore, V(t1) of the first column is 10V. Vin is held at 4V, because CLK of the XY calculating circuit 110 of the pixels of the fifth row to eighth row is in high level (16V), and the p-type MOS-TFT 116 is in an off-state. Therefore, the p-type MOS-TFT 116 is in an off-state and the voltage of the pixel electrode 140 is held.

The mass where section lines are done in FIG. 10 shows a pixel where the liquid crystal drive voltage is written in pixel electrode for this period. As mentioned above, the liquid crystal drive voltage which corresponds to the first gradation value of the block of the first row to fourth row is written in all pixel electrodes in the block corresponding to the first row to fourth row for the selection period of t1.

Next, for the selection period of t2, the voltage of the pixel electrode of the pixel which becomes the second gradation value of the block corresponding to the first row to fourth row is rewritten to the liquid crystal drive voltage corresponding to the second gradation value.

By repeating one by one the operation of above-mentioned t1 and t2 for the fifth row to eighth row in the period of t3 and t4 and for the ninth row to twelvth row in the period of t5 and t6, the liquid crystal drive voltage which corresponds to n-gradation approximation picture signal generated with n-gradation approximation signal calculating circuit can be written in the pixel electrodes of the pixels in the block. During writing liquid crystal drive voltage in the block of other lines VY=0V, and the p-type MOS-TFT of the switch is in an off-state. Therefore, the written liquid crystal drive voltage is held until the block is selected again.

Figure 11:
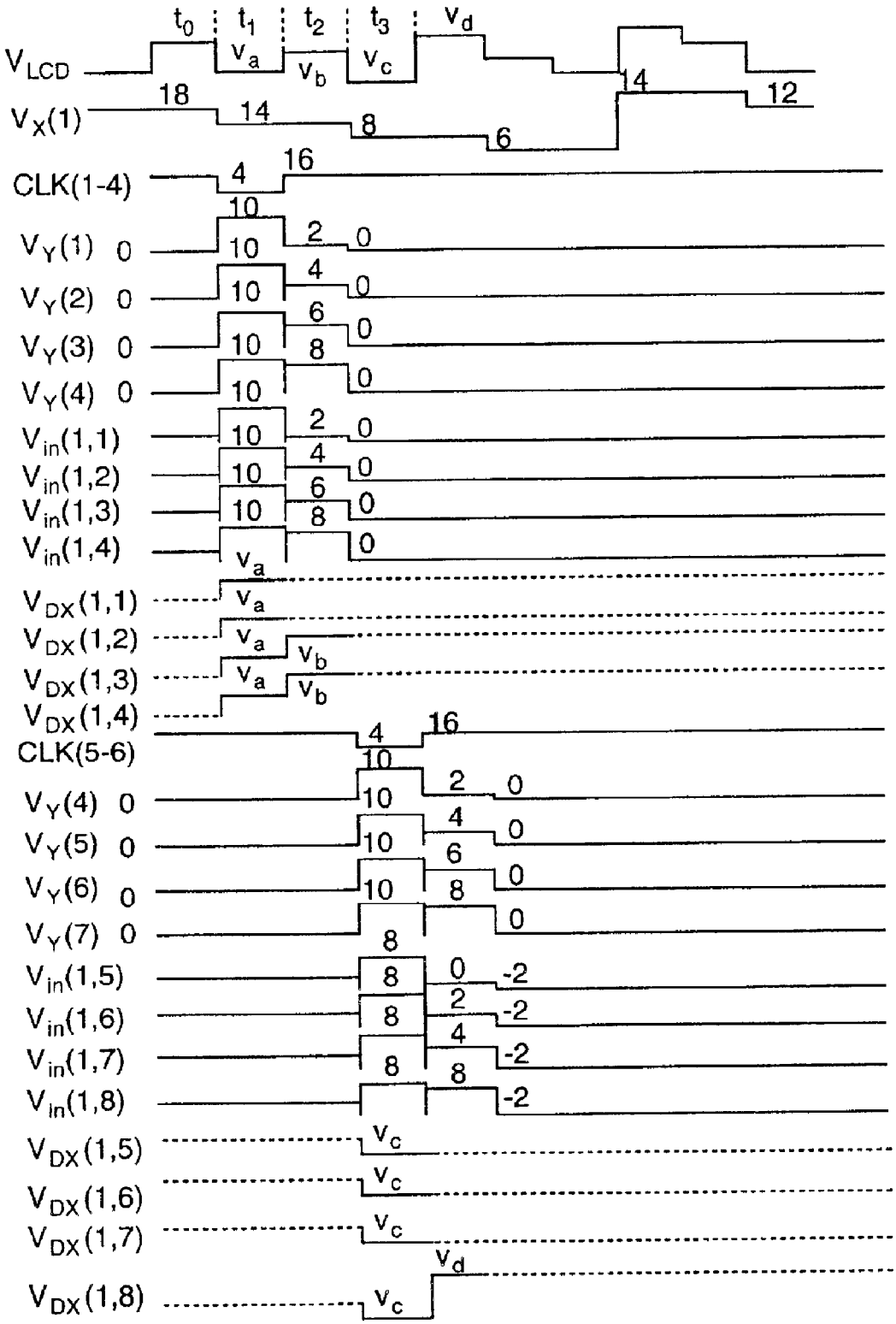
FIG. 11 is a timing chart illustrating the control operation of the display system in the embodiment 3.

FIG. 11 is a timing chart illustrating the control operation of the display system of the embodiment 3. VLCD is the liquid crystal drive voltage common to the block corresponding to the first column to fourth column. CLK(1–4) are clock pulses of the XY calculating circuits of the first row to fourth row. CLK(5–8) are clock pulses of the XY calculating circuits of the fifth row to eighth row. VY(1) to VY(8) are the voltages VY of Y signal line 41 of the first row to the eighth row, respectively. Vin(1,1) to Vin(1,8) are input voltages Vin of the signal comparator 120 of the pixels of the first column, the first row to the first column, the first row, respectively. VPX(1,1) to VPX(1,8) are voltages of pixel electrodes 140 of the pixels of the first column, the first row to the first column, the eighth row, respectively. In VPX(1,1) to VPX(1,8), a broken line shows the state that the p-type MOS-TFT 13 is in an off-state and the voltage of the pixel electrode is held.

For the selection period of t1, VLCD=Va, VX(1)=10V, CLK(1–4)=4V, CLK(5–8)=16V, and VY(1) to VY(4)=10V. Because, CLK(1–4)=4V, the p-type MOS-TFT 116 is in an on-state, and Vin(1,1) to Vin(1,4)=VX(1)=10V. Therefore, all is six V or more, and the p-type MOS-TFT 131 becomes an on-state. As a result, the liquid crystal drive voltage VLCD=Va is written in the pixel electrode 140, and thus VPX(1,1)=VPX(1,2)=VPX(1,3)=VPX(1,4)=Va. Because CLK(5–8)=16V, VY(5) to VY(8)=0V, Vin(1,5) to Vin(1,8) is held at the voltage of 4V or less written before. Therefore, the p-type MOS-TFT 131 is an off-state, and the potential VPX(1,5) to VPX(1,8) of the pixel electrodes 140 are held without changing.

VLCD=Vb, VX(1)=10V, CLK(1–4)=16V, and CLK(5–8)=16V for the next selection period of t2. Because VY(1)=2V, VY(2)=4V, VY(3)=6V, and VY(4)=8V; Vin(1,1)=2V, Vin(1,2)=4V, Vin(1,3)=6V, and Vin(1,4)=8V from Vin(t2)=(VX(t1)+VY(t2)−10). The p-type MOS-TFT 131 of the pixels of which Vin is 6V or more becomes an on-state, and the liquid crystal drive voltage VLCD=Vb is written in the pixel electrode 140. As a result, VPX(1,3)=VPX(1,4)=Vb.

The p-type MOS-TFT 131 of the pixels of which Vin is 4V or less becomes an off-state, and The liquid crystal drive voltage Va written during the period of t1 is held in the pixel electrode 140. As a result, VPX(1,1)=VPX(1,2)=Va. Because CLK(5–8)=16V, and VY(5) to VY(8)=0V, Vin(1,5) to Vin(1,8)≦4V. The p-type MOS-TFT 131 is in an off-state, and the voltage of the pixel is held.

VLCD=VC, VX(1)=8V and CLK(1–4)=16V, CLK(5–8)=4V for the next selection period of t3. Because VY changes to VY(1)=VY(2)=VY(3)=VY(4)=0V, Vin(1,1)=Vin(1,2)=Vin (1,3)=Vin(1,4)=0V from Vin=(VX(t1)+VY(t3)−VY(t1))=(VX(t1)−10). Because Vin is 4V or less, the p-type MOS-TFT 131 of the pixels becomes an off-state, and the liquid crystal drive voltage of the pixel electrode 140 is held. As a result, VPX(1,1)=VPX(1,2)=Va, VPX(1,3)=VPX(1,4)=Vb. Because VY(5)=VY(6)=VY(7)=VY(8)=10V; Vin(1,5)=Vin(1,6)=Vin(1,7)=Vin(1,8)=8V from Vin(t3)=VX(t3).

By repeating the above operation, the liquid crystal drive voltage VLCD corresponding to the n-gradation approximation picture signal generated by the n-gradation approximation calculating circuit 10 is written in pixel electrode 140 of the pixels of the block of the ninth row to twelveth row, the block of the thirteenth row to sixteenth row, etc. one by one.

The above-mentioned operation is ended in the period of one frame, and the picture is displayed by repeating this frame period. It is possible to write the liquid crystal drive voltage in the pixels of one block formed by four rows in two selection period. Therefore, the frequency of the selection period can be adjusted to half, compared with the prior art in which four rows is written in four selection period. The length of the selection period can be doubled by using this embodiment 3 when one frame period is the same.

[Embodiment 4]

Figure 12:
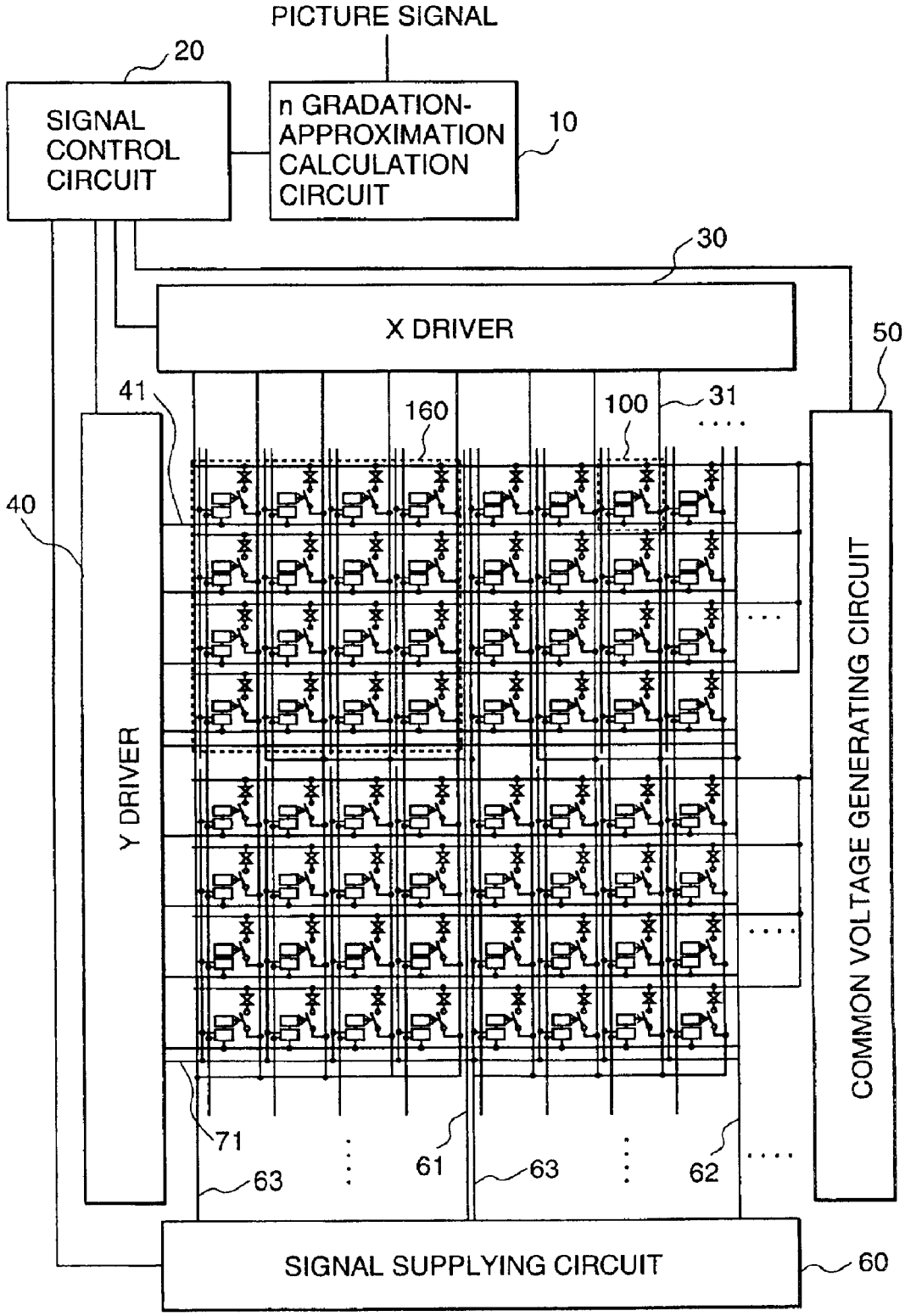
FIG. 12 shows whole configuration of embodiment 4 of the display system according to the present invention.

FIG. 12 shows whole configuration of embodiment 4 of the display system according to the present invention. This embodiment 4 is different from the configuration of FIG. 1 in that two liquid crystal drive voltage lines 62 and 63 are connected to the block formed by four row×four columns. The detailed circuit of the pixel part is the same as embodiment 2 and 3 as shown in FIG. 7.

The second gradation value of the block corresponding to the first row to fourth row and the first gradation value of the block corresponding to the fifth row to eighth row can have been adjusted to a different value in the embodiment 3. However, when one selection period is the same, the embodiment 3 requires twice time to rewrite whole screen compared with the embodiment 2.

The above problem can be solved by using embodiment 4. In the embodiment 4, it becomes possible to rewrite the whole screen at the same time as the embodiment 2 even if the second gradation value of the block corresponding to the first row to fourth row and the first gradation value of the block corresponding to the fifth row to eighth row is different.

The operation of the embodiment 4 according to the present invention will be explained in detail. The picture signal with gradation information on each pixel is input to the n-gradation approximation calculating circuit 10 shown in FIG. 12, in which the pixels are divided into blocks in every four rows×four columns=16, and the n-gradation approximation picture signals is generated by approximating the gradation of the pixel to binary in every block 16. The approximation is performed in away similar to the embodiment 1. The signal generation circuit 20 generates the signal for controlling the output voltages of the X driver, the Y driver, the signal supply circuit, and the common voltage generating circuit according to the n-gradation approximation picture signal.

FIG. 13 is a view illustrating the control operation of the display system of FIG. 12. The 64 pixels in total formed by eight columns in the X direction, and eight rows in the Y direction are shown in FIG. 13. Here, four rows×four columns=16 pixels are assumed to be one block. The columns are defined as a first column, a second column, . . . from the left in an X direction. The rows are defined as a first row, a second row, . . . from the left in an X direction.

First of all, for selection period t1, the voltage of 10V is applied to Y signal line of the first row to fourth row, and 0V is applied to other Y signal lines. The output voltage (Vin) of the XY calculating circuit of the pixel is shown in each mass of FIG. 13. CLK of the XY calculating circuits of the first row to fourth row is at low level (4V), and the p-type MOS-TFT 116 is in an on-state. Therefore, Vin of the pixels of the first row to fourth row is equal to VX. In the example of FIG. 13, VX=10V is applied to the first column, and VY=10V is applied to the first row. Therefore, Vin(1,1)=VX(1)=10V. The voltage according to the n-gradation approximation picture signal of the block formed by the pixels of the first row to fourth row is applied to the X signal line 31.

That is, VX=12V is applied to the column where the pixels of the first row has the first gradation value, and the pixels of the second row to fourth row has the second gradation value. VX=10V is applied to the column where the pixels of the first row to second row has the first gradation value, and the pixels of the third row to fourth row has the second gradation value. VX=8V is applied to the column where the pixels of the first row to third row has the first gradation value, and the pixel of a fourth row has the second gradation value. VX=6V is applied to the column where all pixels of the first row to fourth row have the first gradation value. VX=14V is applied to the column where all pixels of the first row to fourth row have the second gradation value.

As mentioned above, the voltage applied as VX is either 6, 8, 10, 12 or 14V. Therefore, Vin=VX of the pixels of the first row to fourth row for the selection period of t1 when the p-type MOS-TFT 116 exists in an on-state is 6V or more without fail. Because signal comparator 120 has the characteristic shown in FIG. 3, Vout in this case is 0V regardless of VX. Therefore, the p-type MOS-TFT 131 of the switch 130 is in an on-state, and the liquid crystal drive voltage VLCD is written in the pixel electrode 140.

That is, VLCD corresponding to the first gradation value is written in the pixel electrodes of all pixels of the first row to fourth row for the period of t1. Here, the liquid crystal drive voltage VLCD1 is written in the pixel electrode of the first row to fourth row through the liquid crystal drive voltage line 62. As described later, the liquid crystal drive voltage VLCD2 is written in the pixel electrode of the fifth row to eighth row through the liquid crystal drive voltage line 63.

On the other hand, because VY of the fifth row to eighth row is 0V, and the p-type MOS-TFT 116 is in an off-state, the value of vin is 4V or less regardless of the value of VX. Because the signal comparator 120 has the characteristic shown in FIG. 3, Vout in this case is 12V regardless of VX. Therefore, the p-type MOS-TFT 131 of the switch 130 is in an off-state, and the voltage of pixel electrode 140 is held without changing.

Next, for the selection period of t2, VY of the first row to fourth row becomes 2, 4, 6, and 8V in order from the top, and VY of the fifth row to eighth row is held at 10V. VY of other lines is all 0V although not shown in FIG. 13. The voltage is applied to X signal line 31 according to the n-gradation approximation picture signal of the block formed by the pixels of the fifth row to eighth row. That is, VX=12V is applied to the column where the pixels of the first row has the first gradation value, and the pixels of the second row to fourth row has the second gradation value. VX=10V is applied to the column where the pixels of the first row to second row has the first gradation value, and the pixels of the third row to fourth row has the second gradation value.

VX=8V is applied to the column where the pixels of the first row to third row have the first gradation value, and the pixels of the fourth row have the second gradation value. VX=6V is applied to the column where the all pixels of the first row to fourth row have the first gradation value. VX=6V is applied to the column where the all pixels of the first row to fourth row have the second gradation value. As mentioned above, Vin of the first row to fourth row becomes the sum of VX(t1) which is VX for the selection period of t1, and difference ΔVY=VY(t2)−VY(t1) of VX(t1) which is VX for the selection period of t1 and VY(t2) which is VY for the selection period of t2. That is, Vin(t2)=VX(t1)+VY(t2)−VY(t1)=VX(t1)+VY(t2)−10.

The first column of FIG. 13(*b*) shows the state in which the n-gradation approximation signal has been sent, where the pixels of the first row to second row have the first gradation value, and the pixels of the third row to fourth row have the second gradation value. Therefore, V(t1) of the first column is 0V. Vin=VX because CLK of the XY calculating circuit 110 of the pixels of the fifth row to eighth row is in low level (4V), and the p-type MOS-TFT 116 is in an on-state. The voltage applied as VX is either 6, 8, 10, 12 or 14V. Therefore, Vin=VX of the pixels of the first row to fourth row for the selection period of t1 when p-type MOS-TFT 116 is in an on-state is 6V or more without fail. Because signal comparator 120 has the characteristic shown in FIG. 3, Vout in this case is 0V regardless of VX.

Therefore, the p-type MOS-TFT 131 of the switch 130 is in an on-state, and the liquid crystal drive voltage VLCD is written in the pixel electrode 140. That is, VLCD corresponding to the second gradation value of the block of the fifth row to eighth fourth row is written in the pixel electrodes of all pixels of the fifth row to eighth row for the period of t2.

Here, the liquid crystal drive voltage VLCD2 is written in the pixel electrode of the fifth row to eighth row through the liquid crystal drive voltage line 63.

The mass where section lines are done in FIG. 13 shows a pixel where the liquid crystal drive voltage is written in pixel electrode for this period. In this embodiment 4, the second gradation value of the block corresponding to the first row to fourth row is written through the liquid crystal drive voltage line 62, and the first gradation value of the block corresponding to the fifth row to eighth row is written through the liquid crystal drive voltage line 63. Therefore, both values are different from each other.

As mentioned above, the liquid crystal drive voltage which corresponds to the first gradation value of the block corresponding to the first row to fourth row is written in all pixel electrodes of the block corresponding to the first row to fourth row for the selection period of t1.

For the following selection period of t2, the liquid crystal drive voltage corresponding to the second gradation value of the block of the first row to fourth row is written in all the pixel electrodes of the fifth row to eighth row at the same time as rewriting the voltage of pixel electrode of the pixel which becomes the second gradation value of the block corresponding to the first row to fourth row in the liquid crystal drive voltage corresponding to the second gradation value.

By repeating the above operation, the liquid crystal drive voltage which corresponds to the n-gradation approximation picture signal generated by the n-gradation approximation signal calculating circuit can be written in the pixel electrodes of the pixels in the block. The p-type MOS-TFT of the switch is in an off-state while the liquid crystal drive voltage is written in the blocks of other lines. Therefore, the written liquid crystal drive voltage is held until the block is selected again. The liquid crystal drive voltage which corresponds to the n-gradation approximation signal is written in the pixel electrodes of all blocks by repeating the above-mentioned operation one by one.

Figure 14:
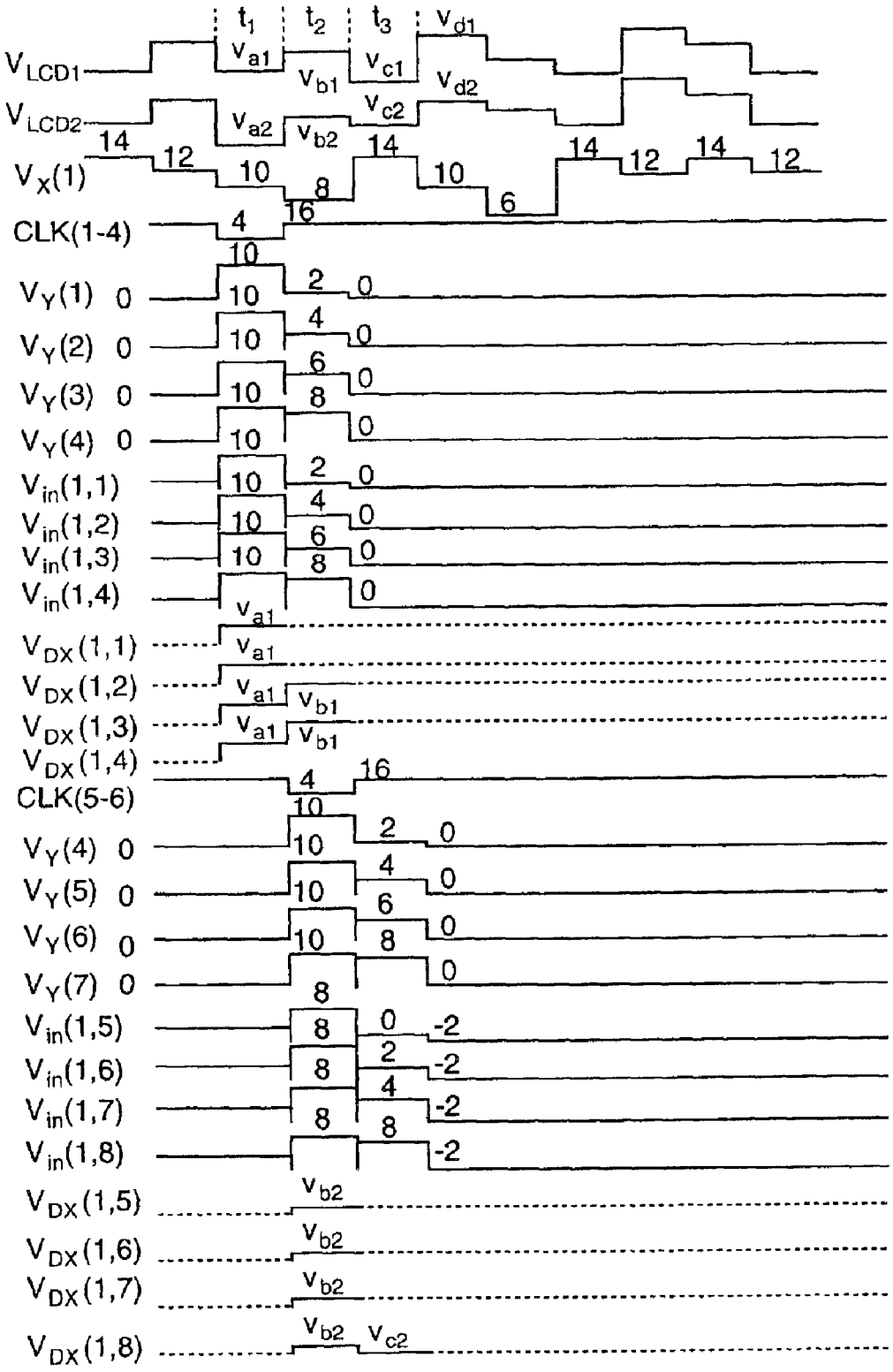
FIG. 14 is a timing chart to which the control action of the display system of FIG. 12.

FIG. 14 is a timing chart illustrating the control operation of the display system of FIG. 12. VLCD1 is the liquid crystal drive voltage common to the first row to fourth row, the ninth row to the twelvth row, etc. among the blocks corresponding to the first column to fourth column. VLCD2 is the liquid crystal drive voltage common to the fifth row to eighth row, the thirteenth row to the sixteenth row, etc. among the blocks corresponding to the first column to fourth column. CLK(1–4) are clock pulses of the XY calculating circuits of the first row to fourth row. CLK(5–8) are clock pulses of the XY calculating circuits of the fifth row to eighth row. VY(1) to VY(8) are the voltages VY of Y signal line 41 of the first row to the eighth row, respectively. Vin(1,1) to Vin(1,8) are input voltages Vin of the signal comparator 120 of the pixels of the first column, the first row to the first column, the eighth row, respectively. VPX(1,1) to VPX(1,8) are voltages of pixel electrodes 140 of the pixels of the first column, the first row to the first column, the eighth row, respectively. In VPX(1,1) to VPX(1,8), a broken line shows the state that the p-type MOS-TFT 13 is in an off-state and the voltage of the pixel electrode is held.

For the selection period of t1, VLCD1=Va1, VLCD2=Va2, VX(1)=10V, CLK(1–4)=4V, CLK(5–8)=16V, and VY(1) to VY(4)=10V. Because, CLK(1–4)=4V, the p-type MOS-TFT 116 is in an on-state, and Vin(1,1) to Vin(1,4)=VX(1)=10V. Therefore, all is six V or more, and the p-type MOS-TFT 131 becomes an on-state. As a result, the liquid crystal drive voltage VLCD1=Va1 is written in the pixel electrode 140, and thus VPX(1,1)=VPX(1,2)=VPX(1,3)=VPX(1,4)=Va1. Because CLK(5–8)=16V, VY(5) to VY(8)=0V, Vin(1,5) to Vin(1,8) is held at the voltage of 4V or less written before. Therefore, the p-type MOS-TFT 131 is an off-state, and the potential VPX(1,5) to VPX(1,8) of the pixel electrodes 140 are held without changing.

VLCD1=Vb1, VLCD2=Vb2, VX(1)=8V, CLK(1–4)=16V, and CLK(5–8)=4V for the next selection period of t2. Because VY(1)=2V, VY(2)=4V, VY(3)=6V, and VY(4)=8V; Vin(1,1)=2V, Vin(1,2)=4V, Vin (1,3)=6V, and Vin(1,4)=8V from Vin(t2)=(VX(t1)+VY(t2)−10).The p-type MOS-TFT 131 of the pixels of which Vin is 6V or more becomes an on-state, and The liquid crystal drive voltage VLCD1=Vb1 is written in the pixel electrode 140. As a result, VPX(1,3)=VPX(1,4)=Vb1. The p-type MOS-TFT 131 of the pixels of which Vin is 4V or less becomes an off-state, and The liquid crystal drive voltage Va1 written during the period of t1 is held in the pixel electrode 140. As a result, VPX(1,1)=VPX(1,2)=Va1. Because CLK(5–8)=4V, and VY(5) to VY(8)=10V; Vin(1,5) to Vin(1,8)=VX=8V. That is, all is 6V or more. The p-type MOS-TFT 131 becomes an on-state. As a result, the liquid crystal drive voltage VLCD=Vb2 is written in pixel electrode 140. As a result, VPX(1,5)=VPX(1,6)=VPX(1,7)=VPX(1,8)=Vb2.

VLCD1=Vc1, VLCD2=Vc2, VX(1)=14V and CLK(1–4)=CLK(5–8)=16V for the next selection period of t3. Because VY changes to VY(1)=VY(2)=VY(3)=VY(4)=0V, Vin(1,1)=Vin(1,2)=Vin (1,3)=Vin(1,4)=0V from Vin=(VX(t1)+VY(t3)−VY(t1))=(VX(t1)−10). Because Vin is 4V or less, the p-type MOS-TFT 131 of the pixels becomes an off-state, and the liquid crystal drive voltage of the pixel electrode 140 is held. As a result, VPX(1,1)=VPX(1,2)=Va1, VPX(1,3)=VPX(1,4)=Vb1. Because VY(5)=2V, VY(6)=4V, VY(7)=6V, VY(8)=8V; Vin(1,5)=0V, Vin(1,6)=2V, Vin(1, 7)=4V, Vin(1,8)=6V from Vin(t3)=(VX(t2)+VY(t2)−VY(t3))=(VX(t2)+VY(t2)−10).

The p-type MOS-TFT 131 of the pixels of which Vin is 6V or more becomes an on-state, and The liquid crystal drive voltage VLCD=Vc2 is written in the pixel electrode 140. As a result, VPX(1,8)=Vc2. The p-type MOS-TFT 131 of the pixels of which Vin is 4V or less becomes an off-state, and The liquid crystal drive voltage Vb2 written during the period of t2 is held in the pixel electrode 140. As a result, VPX(1,5)=VPX(1,6)=VPX(1,7)=VPX(1,8)=Vb2.

By repeating the above operation, the liquid crystal drive voltage VLCD corresponding to the n-gradation approximation picture signal generated by the n-gradation approximation calculating circuit 10 is written in pixel electrode 140 of the pixels of the block of the ninth row to twelveth row, the block of the thirteenth row to sixteenth row, etc. one by one.

The above-mentioned operation is ended in the period of one frame, and the picture is displayed by repeating this frame period. It is possible to write the liquid crystal drive voltage in the pixels of one block formed by four rows in two selection period. Therefore, the frequency of the selection period can be adjusted to half, compared with the prior art in which four rows is written in four selection period. The length of the selection period can be doubled by using this embodiment 2 when one frame period is the same.

Further, in this embodiment 4, the second selection period and the first selection period of the block formed with the next four rows are the same. Therefore, the selection period doubles further, and thus the selection time of quadruple in total can be secured. This means that it is possible to display the quadruple number of rows compared with prior art, in case of the case with the same signal electrode as prior art.

[Embodiment 5]

The whole configuration of the embodiment 5 of the present invention is the same as that of FIG. 1, in which the detailed circuit diagram of the pixel part is the same as that of FIG. 7 according to the embodiment 2. Although the high level of CLK is 16V in the embodiment 2, it is possible to decrease the high level of CLK by using the embodiment 5.

The operation of the embodiment 3 according to the present invention will be explained in detail. The picture signal with gradation information on each pixel is input to the n-gradation approximation calculating circuit 10 shown in FIG. 1, in which the pixels are divided into blocks in every four rows X four columns=16, and the n-gradation approximation picture signals is generated by approximating the gradation of the pixel to binary in every block 16. The approximation is performed in a way similar to the embodiment 1. The signal generation circuit 20 generates the signal for controlling the output voltages of the X driver, the Y driver, the signal supply circuit, and the common voltage generating circuit according to the n-gradation approximation picture signal.

FIG. 15 is a view illustrating the control operation of the display system of the embodiment 5. The 64 pixels in total formed by eight columns in the X direction, and eight rows in the Y direction are shown in FIG. 15. Here, four rows× four columns=16 pixels are assumed to be one block. The columns are defined as a first column, a second column, from the left in an X direction. The rows are defined as a first row, a second row, . . . from the left in an X direction.

First of all, for selection period t1, the voltage of 6V is applied to Y signal line of the first row to fourth row, and 0V is applied to other Y signal lines. The output voltage (Vin) of the XY calculating circuit of the pixel is shown in each mass of FIG. 15. CLK of the XY calculating circuits of the first row to fourth row is at low level (0V), and the p-type MOS-TFT 116 is in an on-state. Therefore, Vin of the pixels of the first row to fourth row is equal to VX.

In the example of FIG. 15, Vx(1)=2V is applied to the first column, and VY=6V is applied to the first row. Therefore, Vin(1,1)=VX(1)=2V. The voltage according to the n-gradation approximation picture signal of the block formed by the pixels of the first row to fourth row is applied to the X signal line 31.

That is, VX=8V is applied to the column where the pixels of the first row has the first gradation value, and the pixels of the second row to fourth row has the second gradation value. VX=6V is applied to the column where the pixels of the first row to second row has the first gradation value, and the pixels of the third row to fourth row has the second gradation value. VX=4V is applied to the column where the pixels of the first row to third row has the first gradation value, and the pixel of a fourth row has the second gradation value. VX=2V is applied to the column where all pixels of the first row to fourth row have the first gradation value. VX=10V is applied to the column where all pixels of the first row to fourth row have the second gradation value. As mentioned above, the voltage applied as VX is either 2, 4, 6, 8 or 10V.

On the other hand, because CLK of the fifth row to eighth row is high level (12V), the p-type MOS-TFT 116 is in an off-state. Because VY of the fifth row to eighth row is 0V, the the value of Vin is held at 4V or less regardless of the value of VX. Because the signal comparator 120 has the characteristic shown in FIG. 3, Vout in this case is 12V regardless of VX. Therefore, the p-type MOS-TFT 131 of the switch 130 is in an off-state, and the voltage of pixel electrode 140 is held without changing.

Next, for the selection period of t2, VY of the first row to fourth row becomes 10V, and VY of the fifth row to eighth row becomes 6V. VY of other lines is all 0V though not shown in FIG. 15. Further, CLK of the first row to fourth row becomes a high level (12V), and the p-type MOS-TFT 116 is an off-state. Vin of the first row to fourth row becomes the sum of VX(t1) which is VX for the selection period of t1, and difference ΔVY=VY(t2)−VY(t1) of VX(t1) which is VX for the selection period of t1 and VY(t2) which is VY for the selection period of t2. That is, Vin(t2)=VX(t1)+VY(t2)−VY(t1)=VX(t1)+VY(t2)−10. As mentioned above, the voltage applied as VX is either 2, 4, 6, 8 or 10V. Therefore, Vin(t2) becomes 6V or more.

Because the signal comparator 120 has the characteristic shown in FIG. 3, Vout in this case is 0V regardless of VX. Therefore, the p-type MOS-TFT 131 of the switch 130 is in an on-state, and the liquid crystal drive voltage VLCD is written in the pixel electrode 140. That is, VLCD corresponding to the first gradation value is written in all pixel electrodes of the pixels of the first row to fourth row for the period of t2. Here, VLCD of other blocks has a different voltage value though VLCD of the same block has the same voltage. That is, the first gradation value is different in every block. The voltage is applied to X signal line 31 according to n-gradation approximation picture signal of the block formed by the pixels of the fifth row to eighth row.

That is, VX=8V is applied to the column where the pixels of the first row has the first gradation value, and the pixels of the second row to fourth row has the second gradation value. VX=6V is applied to the column where the pixels of the first row to second row has the first gradation value, and the pixels of the third row to fourth row has the second gradation value. VX=4V is applied to the column where the pixels of the first row to third row has the first gradation value, and the pixel of a fourth row has the second gradation value. VX=2V is applied to the column where all pixels of the first row to fourth row have the first gradation value. VX=10V is applied to the column where all pixels of the first row to fourth row have the second gradation value. Vin=VX, because CLK of XY calculating circuit 110 of the pixel of the fifth row to eighth row is at low level (0V), and the p-type MOS-TFT 116 is in an on-state. The voltage applied as VX is either 2, 4, 6, 8 or 10V.

Next, for the period of t3, the voltages 2V, 4V, 6V, and 8V are applied in order from the top to the Y signal lines of the first row to fourth row, and 10V is applied to Y signal lines of the fifth row to eighth row. 6V is applied to VY of the ninth row to twelveth row, and 0V is applied to all VY of other rows though not shown in FIG. 15.

Further, CLK of the fifth row to eighth row also becomes a high level (12V), and the p-type MOS-TFT 116 becomes an off-state in high level. Because CLK of the XY calculating circuit of the first row to fourth row is in a high level (12V) and the p-type MOS-TFT 116 is in an off-state, Vin of the first row to fourth row becomes the sum of VX(t1) which is VX for the selection period of t1, and difference ΔVY1=VY(t3)−VY(t1) of VX(t1) which is VX for the selection period of t1 and VY(t3) which is VY for the selection period of t3. That is, Vin(t3)=VX(t1)+VY(t3)−VY(t1)=VX(t1)+VY(t3)−6.

The first column of FIG. 15(*c*) shows the state in which the n-gradation approximation signal has been sent, where all the pixels of the first row to fourth row have the second gradation value, and the pixels of the third row to fourth row have the second gradation value. Therefore, V(t1) of the first column is 0V. Vin=VX, because CLK of the XY calculating circuit 110 of the pixels of the fifth row to eighth row is in low level (0V), and the p-type MOS-TFT 116 is in an on-state.

In the example of FIG. 15, VX=2V is applied to the first column, and VY=6V is applied to the first row. Therefore, Vin(1,1)=VX(1)=2V. The voltage according to the n-gradation approximation picture signal of the block formed by the pixels of the first row to fourth row is applied to the X signal line 31.

That is, VX=8V is applied to the column where the pixels of the first row has the first gradation value, and the pixels of the second row to fourth row has the second gradation value. VX=6V is applied to the column where the pixels of the first row to second row has the first gradation value, and the pixels of the third row to fourth row has the second gradation value. VX=4V is applied to the column where the pixels of the first row to third row has the first gradation value, and the pixel of a fourth row has the second gradation value. VX=2V is applied to the column where all pixels of the first row to fourth row have the first gradation value. VX=10V is applied to the column where all pixels of the first row to fourth row have the second gradation value. As mentioned above, the voltage applied as VX is either 6, 8, 10, 12 or 14V.

On the other hand, because CLK of the fifth row to eighth row is at high level (12V), the p-type MOS-TFT 116 is in an off-state. Further, because VY is 0V, the value of Vin is 4V or less without changing. Because the signal comparator 120 has the characteristic shown in FIG. 3, Vout in this case is 12V regardless of VX. Therefore, the p-type MOS-TFT 131 of the switch 130 is in an off-state, and the voltage of pixel electrode 140 is held without changing.

Next, for the selection period of t2, VY of the first row to fourth row becomes 2, 4, 6, and 8V in order from the top, and VY of the fifth row to eighth row is held at 10V. VY of other lines is all 0V although not shown in FIG. 10. Further, CLK of the first row to fourth row becomes a high level (16V), and the p-type MOS-TFT 116 becomes an off-state. As mentioned above, Vin of the first row to fourth row becomes the sum of VX(t1) which is VX for the selection period of t1, and difference A VY=VY(t2)−VY(t1) of VX(t1) which is VX for the selection period of t1 and VY(t2) which is VY for the selection period of t2. That is, Vin(t2)=VX(t1)+VY(t2)−VY(t1)=VX(t1)+VY(t2)−10.

Because VX(t1) is either 2, 4, 6, 8 or 10V as mentioned above, Vin(t2) becomes 6V or more. Because signal comparator 120 has the characteristic shown in FIG. 3, Vout in this case is 0V regardless of VX. Therefore, the p-type MOS-TFT 131 of the switch 130 is in an on-state, and the liquid crystal drive voltage VLCD is written in the pixel electrode 140. That is, VLCD corresponding to the first gradation value is written in the pixel electrodes of all pixels of the first row to fourth row for the period of t2.

Here, VLCD of other blocks has a different voltage value though VLCD of the same block is the same. That is, the first gradation value is different in every block. The voltage according to the n-gradation approximation picture signal of the block formed by the pixels of the first row to fourth row is applied to the X signal line 31.

That is, VX=8V is applied to the column where the pixels of the ninth row has the first gradation value, and the pixels of the tenth row to twelvth row has the second gradation value. VX=6V is applied to the column where the pixels of the ninth row to tenth row has the first gradation value, and the pixels of the eleventh row to twelvth row has the second gradation value. VX=4V is applied to the column where the pixels of the ninth row to eleventh row has the first gradation value, and the pixel of a twelvth row has the second gradation value. VX=2V is applied to the column where all pixels of the ninth row to twelvth row have the first gradation value. VX=10V is applied to the column where all pixels of the first row to fourth row have the second gradation value.

Further, CLK of the fifth row to eighth row becomes a high level (12V), and the p-type MOS-TFT 116 becomes an off-state. As mentioned above, Vin of the fifth row to eighth row becomes the sum of VX(t2) which is VX for the selection period of t2, and difference ΔVY=VY(t3)−VY(t2) of VX(t2) which is VX for the selection period of t2 and VY(t3) which is VY for the selection period of t3. That is, Vin(t3)=VX(t2)+VY(t3)−VY(t2)=VX(t2)+4. Because VX(t2) is either 2, 4, 6, 8 or 10V as mentioned above, Vin(t3) becomes 6V or more. Because signal comparator 120 has the characteristic shown in FIG. 3, Vout in this case is 0V regardless of VX. Therefore, the p-type MOS-TFT 131 of the switch 130 is in an on-state, and the liquid crystal drive voltage VLCD is written in the pixel electrode 140.

That is, VLCD corresponding to the fifth row to eighth row is written in the pixel electrodes of all pixels of the fifth row to eighth row for the period of t3.

The mass where section lines are done in FIG. 5 shows a pixel where the liquid crystal drive voltage is written in pixel electrode for this period. In this embodiment, the second gradation value of the block corresponding to the first row to fourth row becomes the same value as the first gradation value of the block corresponding to the fifth row to eighth row. As mentioned above, the liquid crystal drive voltage which corresponds to the first gradation value of the block corresponding to the first row to fourth row is written in all pixel electrodes of the block corresponding to the first row to fourth row for the selection period of t1.

For the following selection period of t3, the liquid crystal drive voltage corresponding to the second gradation value of the block of the first row to fourth row is written in all the pixel electrodes of the fifth row to eighth row at the same time as rewriting the voltage of pixel electrode of the pixel which becomes the second gradation value of the block corresponding to the first row to fourth row in the liquid crystal drive voltage corresponding to the second gradation value.

By repeating the above operation, the liquid crystal drive voltage which corresponds to the n-gradation approximation picture signal generated by the n-gradation approximation signal calculating circuit can be written in the pixel electrodes of the pixels in the block. The p-type MOS-TFT of the switch is in an off-state while the liquid crystal drive voltage is written in the blocks of other lines. Therefore, the written liquid crystal drive voltage is held until the block is selected again.

The liquid crystal drive voltage which corresponds to the n-gradation approximation signal is written in the pixel electrodes of all blocks by repeating the above-mentioned operation one by one.

Figure 16:
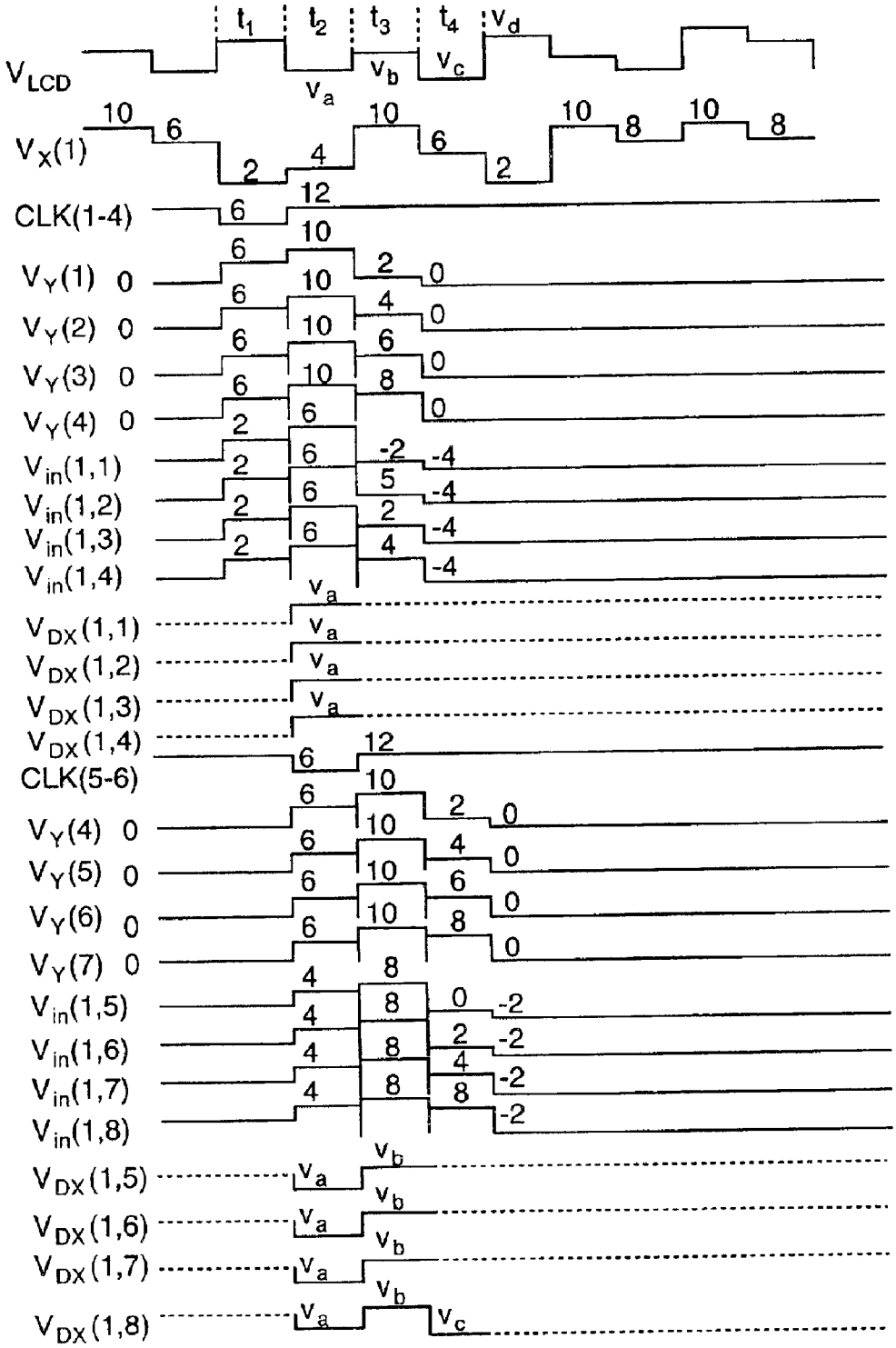
FIG. 16 is a timing chart illustrating the control operation of the display system in the embodiment 5.

FIG. 16 is a timing chart illustrating the control operation of the display system of the embodiment 5. VLCD is the liquid crystal drive voltage common to the block corresponding to the first column to fourth column. CLK(1–4) are clock pulses of the XY calculating circuits of the first row to fourth row. CLK(5–8) are clock pulses of the XY calculating circuits of the fifth row to eighth row. VY(1) to VY(8) are the voltages VY of Y signal line 41 of the first row to the eighth row, respectively. Vin(1,1) to Vin(1,8) are input voltages Vin of the signal comparator 120 of the pixels of the first column, the first row to the first column, the eighth row, respectively. VPX(1,1) to VPX(1,8) are voltages of pixel electrodes 140 of the pixels of the first column, the first row to the first column, the eighth row, respectively. In VPX(1,1) to VPX(1,8), a broken line shows the state that the p-type MOS-TFT 13 is in an off-state and the voltage of the pixel electrode is held.

VX(1)=2V, CLK(1–4)=0V, CLK(5–8)=12 V, and VY(1) to VY(4)=6V at the selection period t1. The p-type MOS-TFT 116 is in an on-state because CLK(1–4)=0V. Therefore, Vin(1,1) to Vin(1,4)=VX(1)=2V. Because CLK(5–8)=12V and VY(5) to VY(8)=0V, Vin(1,5) to Vin(1,8) is held at 4V or less written before. Therefore, the p-type MOS-TFT 131 is in an off-state, and the potential VPX(1,5) to VPX(1,8) of the pixel electrode 140 are held without changing.

Next, for the selection period of t2, VLCD=Va, VX(1)=10V, CLK(1–4)=12V, and CLK(5–8)=0V. Because VY(1)=VY(2)=VY(3)=VY(4)=10V, Vin(1,1)=Vin(1,2)=Vin(1,3)=Vin(1,4)=6V from Vin(t2)=VX(t1)+4.

The p-type MOS-TFT 131 of the pixels of which Vin is 6V or more becomes an on-state, and the liquid crystal drive voltage VLCD=Va is written in the pixel electrode 140. As a result, VPX(1,1)=VPX(1,2)=VPX(1,3)=VPX(1,4)=Va. VY(5) to VY(8)=6V. The p-type MOS-TFT 116 is in an on-state because CLK(5–8)=0V. Therefore, Vin(1,5) to Vin (1,8)=VX(1)=4V.

VLCD=Vb, VX(1)=10V and CLK(1–4)=CLK(5–8)=12V for the next selection period of t3. Because VY changes to VY(1)=2V, VY(2)=4V, VY(3)=6V, and VY(4)=8V; Vin(1,1)=−2V, Vin(1,2)=0V, Vin(1,3)=2V, and Vin(1,4)=4V from Vin=VX(t1)+VY(t3)−6. In this case, because Vin is 4V or less, the p-type MOS-TFT 131 of the pixel is in an off-state, and the voltage of pixel electrode 140 is held. That is, VPX(1,1)=VPX(1,2)=VPX(1,3)=VPX(1,4)=Va. Because VY(5)=VY(6)=VY(7)=VY(8)=10V, Vin of the fifth row to eighth row is Vin(1,5)=Vin(1,6)=Vin(1,7)=Vin(1,8)=8V from Vin(t3)=VX(t2)+4. The liquid crystal drive voltage VLCD=Vb is written in all pixel electrodes 140 because Vin is 6V or more. For the following selection period of t4, VLCD=Vc, VX(1)=6V, and CLK(1–4)=CLK(5–8)=12V. All of Vin become 4V or less because VY changes into VY(1)=VY(2)=VY(3)=VY(4)=0V. Therefore, the p-type MOS-TFT 131 of the pixel is in an off-state, and the voltage of pixel electrode 140 is held as it is. That is, VPX(1,1)=VPX(1,2)=VPX(1,3)=VPX(1,4)=Va. Vin of the fifth row to eighth row is Vin(1,5)=0V, Vin(1,6)=2V, Vin(1,7)=4V, and Vin(1,8)=6V from Vin(t4)=VX(t2)−6, because VY(5)=2V, VY(6)=4V, VY(7)=6V, and VY(8)=8V. The liquid crystal drive voltage VLCD=VC is written to the pixel electrode 140 of which the voltage is 6V or more.

The voltage of the pixel electrode 140 of which Vin is 4V or less is held at VLCD=Vb. Therefore, VPX(1,5)=VPX(1,6)=VPX(1,7)=VPX(1,8)=Vc.

By repeating the above operation, the liquid crystal drive voltage VLCD corresponding to the n-gradation approximation picture signal generated by the n-gradation approximation calculating circuit 10 is written in pixel electrode 140 of the pixels of the block of the ninth row to twelveth row, the block of the thirteenth row to sixteenth row, etc. one by one. The above-mentioned operation is ended in the period of one frame, and the picture is displayed by repeating this frame period.

It is possible to write the liquid crystal drive voltage in the pixels of one block formed by four rows in two selection period. Therefore, the frequency of the selection period can be adjusted to half, compared with the prior art in which four rows is written in four selection period. The length of the selection period can be doubled by using this embodiment 5 when one frame period is the same.

Further, the second selection period and the first selection period of the block formed with the next four rows are the same for this embodiment 5. Therefore, the selection period doubles further, and thus the selection time of quadruple in total can be secured. This means that it is possible to display the quadruple number of rows compared with prior art, in case of the case with the same signal electrode as prior art.

[Embodiment 6]

Figure 17:
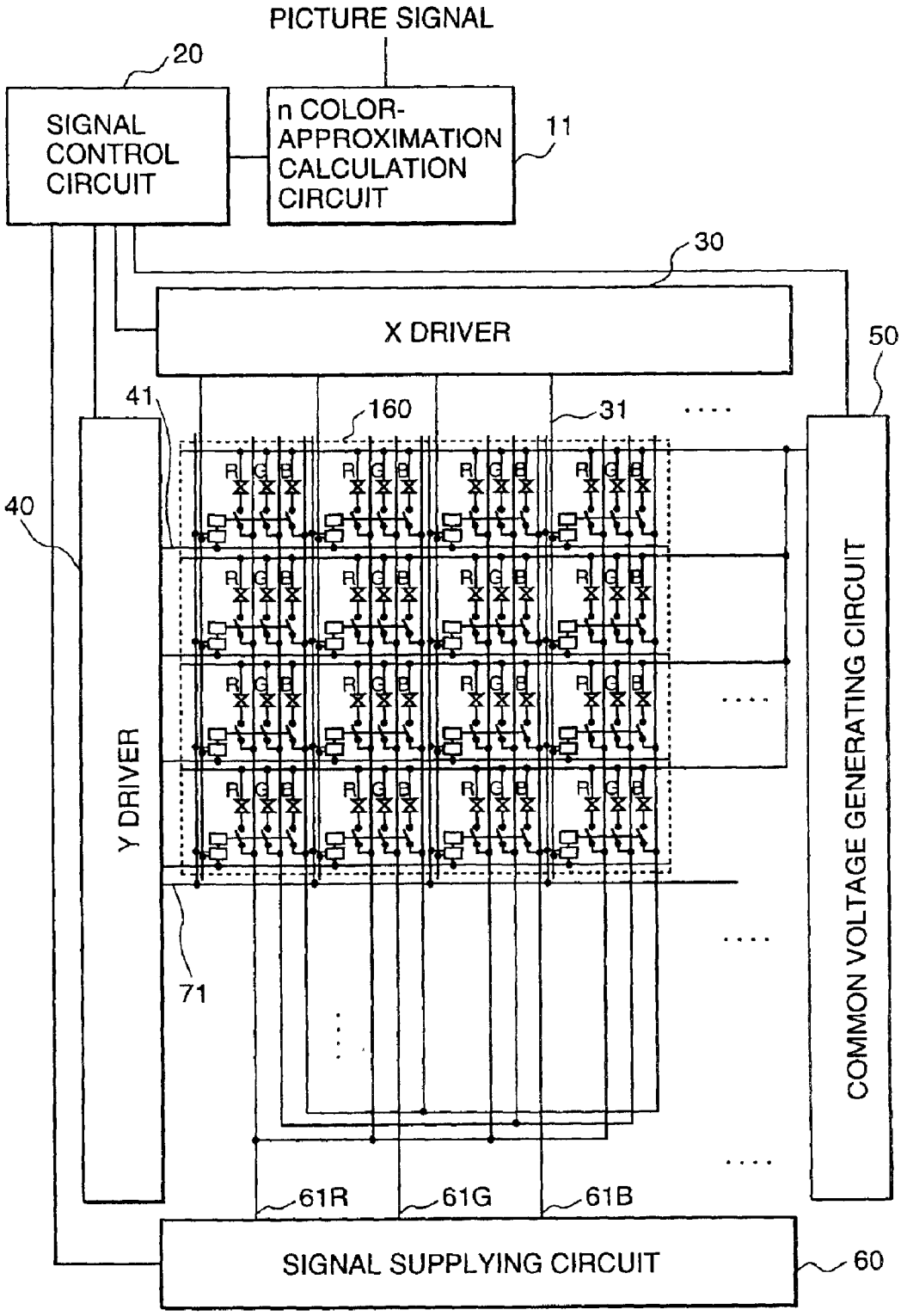
FIG. 17 shows whole configuration of embodiment 6 of the display system according to the present invention.

FIG. 17 shows whole configuration of embodiment 6 of the display system according to the present invention. This display system comprises an n-colors approximation calculating circuit 11 for converting the input picture signal into an n-colors approximation picture signal approximated to two colors at every block, a signal generation circuit 20 for supplying a desired signal to the X driver 30, the Y driver 40, the common voltage generating circuit 50, and the signal supply circuit 60, according to the n-colors approximation picture signal output from the n-colors approximation calculating circuit 11, a plurality of pixel parts 100 provided at the intersection parts of an X signal line 31 connected to the X driver 30 and extended in a Y direction and a Y signal line 41 connected to the Y driver 40 and extended in a X direction.

Figure 18:
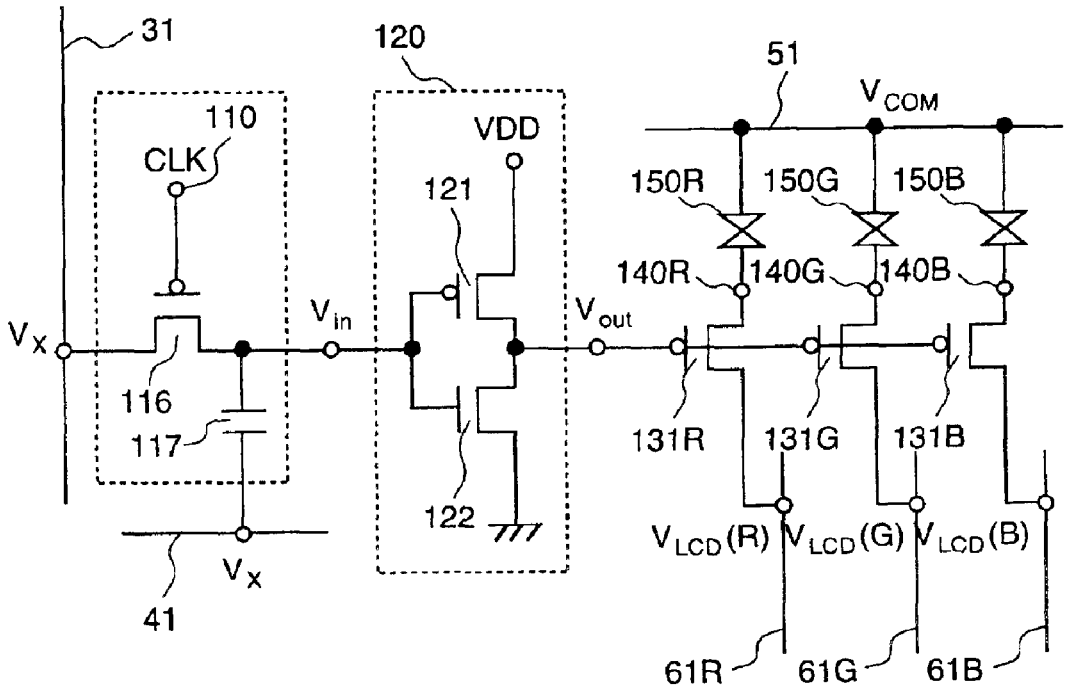
FIG. 18 shows one example of a detailed circuit structure of pixel parts 100 of FIG. 17.

FIG. 18 shows one example of the detailed circuit structure of pixel parts 100 shown in FIG. 17. An XY calculating circuit 110 comprises a p-type MOS-TFT 116 and a capacitor 117. A drain terminal of the p-type MOS-TFT 116 is connected to X signal line 31, and its source terminal is connected to capacitor 117. The other terminal of capacitor 117 is connected to the Y signal line 41. A clock pulse CLK is supplied by the Y driver 40 through a clock pulse line 71. A signal comparator 120 comprises a p-type MOS-TFT 121 and an n-type MOS-TFT 122 mutually connected in series.

The switch of a red pixel comprises p-type MOS-TFT 131R. A source terminal of the p-type MOS-TFT 131R is connected to a pixel electrode 140R of the red pixel, and a drain terminal is connected to a liquid crystal drive signal line 61R which corresponds to a red pixel. The switch of a green pixel comprises a p-type MOS-TFT 131G. A source terminal of the p-type MOS-TFT 131G is connected to a pixel electrode 140G of the green pixel, and its drain terminal is connected to a liquid crystal drive signal line 61G which corresponds to the green pixel. The switch of a blue pixel comprises a p-type MOS-TFT 131B. A source terminal of the p-type MOS-TFT 131B is connected to a pixel electrode 140B of the blue pixel, and its drain terminal is connected to a liquid crystal drive signal line 61B which corresponds to the blue pixel. The gate terminals of the p-type MOS-TFTs 131R,131G,131B of red pixel, green pixel, and blue pixel which are adjacent are connected to an output terminal of the same signal comparator.

In this embodiment 6, there is provided just one set of the XY calculating circuit 110 and the signal comparator 120 for three pixels (red, green, and blue). Therefore, the number of the XY calculating circuit and the signal comparator is reduced to ⅓ compared with the $1^{st}$ to the $5^{th}$ embodiments. This structure brings the improvement of the yield by the reduction in the number of parts and the improvement of brightness by allocating the area obtained by the reduction to the expansion of an effective display area.

[Embodiment 7]

Figure 19:
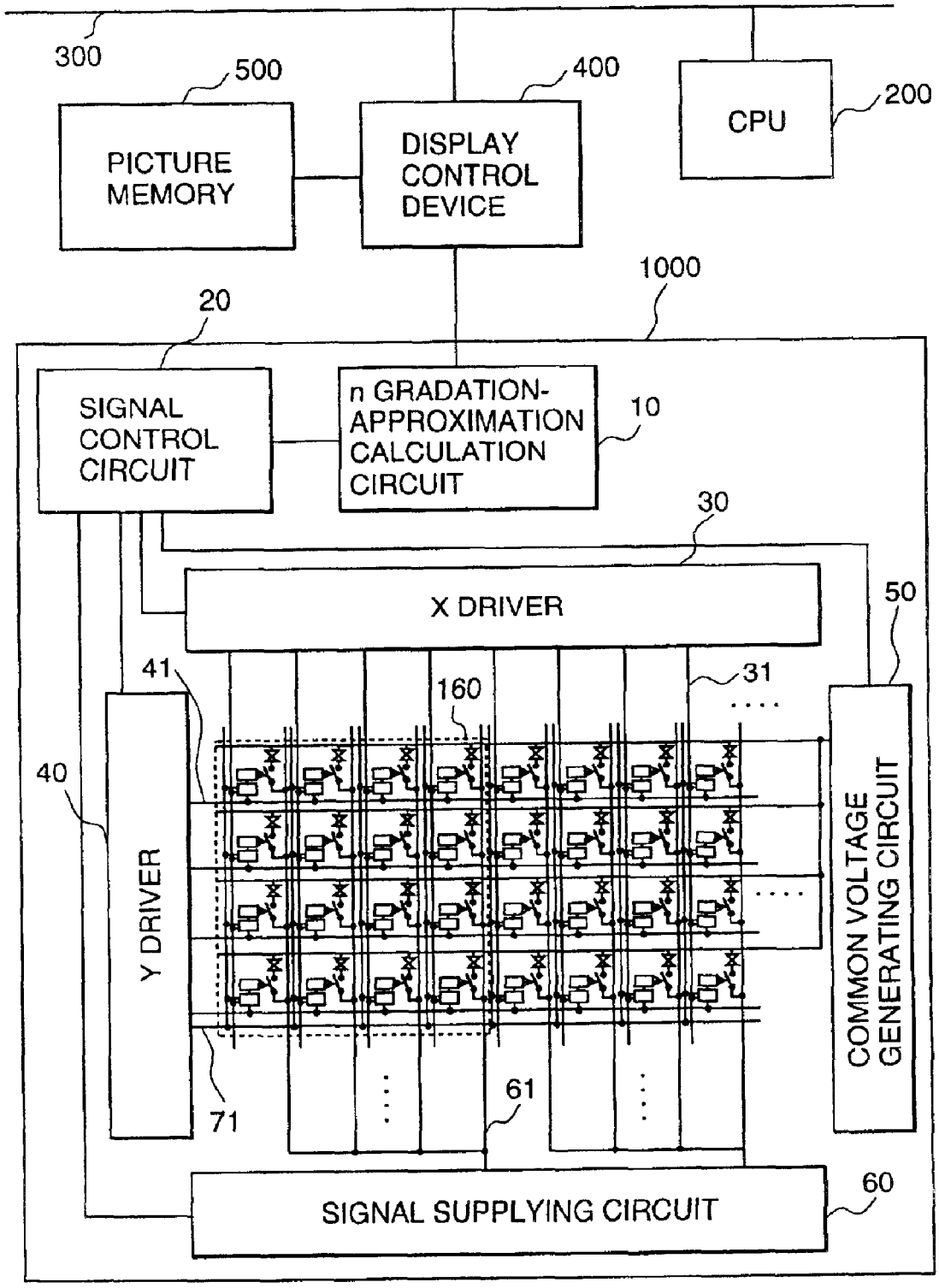
FIG. 19 shows whole configuration of embodiment 7 of the display system according to the present invention.

FIG. 19 shows whole configuration of an embodiment 7 of the display system according to the present invention. This display system comprises a CPU 200 for generating an picture drawing instruction, and a display control 400 for generating a picture signal based on the picture drawing instruction, storing the generated picture signal in a memory 500, and inputting the generated picture signal to a liquid crystal display apparatus 1000.

The liquid crystal display apparatus 1000 comprises an n-gradation approximation calculating circuit 10 for converting the input picture signal into an n-gradation approximation picture signal approximated to binary gradation at every block, a signal generation circuit 20 for supplying a desired signal to the X driver 30, the Y driver 40, the common voltage generating circuit 50, and the signal supply circuit 60, according to the n-gradation approximation picture signal output from the n-gradation approximation calculating circuit 11, a plurality of pixel parts 100 provided at the intersection parts of an X signal line 31 connected to the X driver 30 and extended in a Y direction and a Y signal line 41 connected to the Y driver 40 and extended in a X direction.

Because the n-gradation approximation calculating circuit is in the liquid crystal display apparatus 1000, the elements of the same specification as the configuration to the liquid crystal display apparatus in which the prior art is used for the CPU 200, the bus line 300, the display control 400, and the picture memory 500.

[Embodiment 8]

Figure 20:
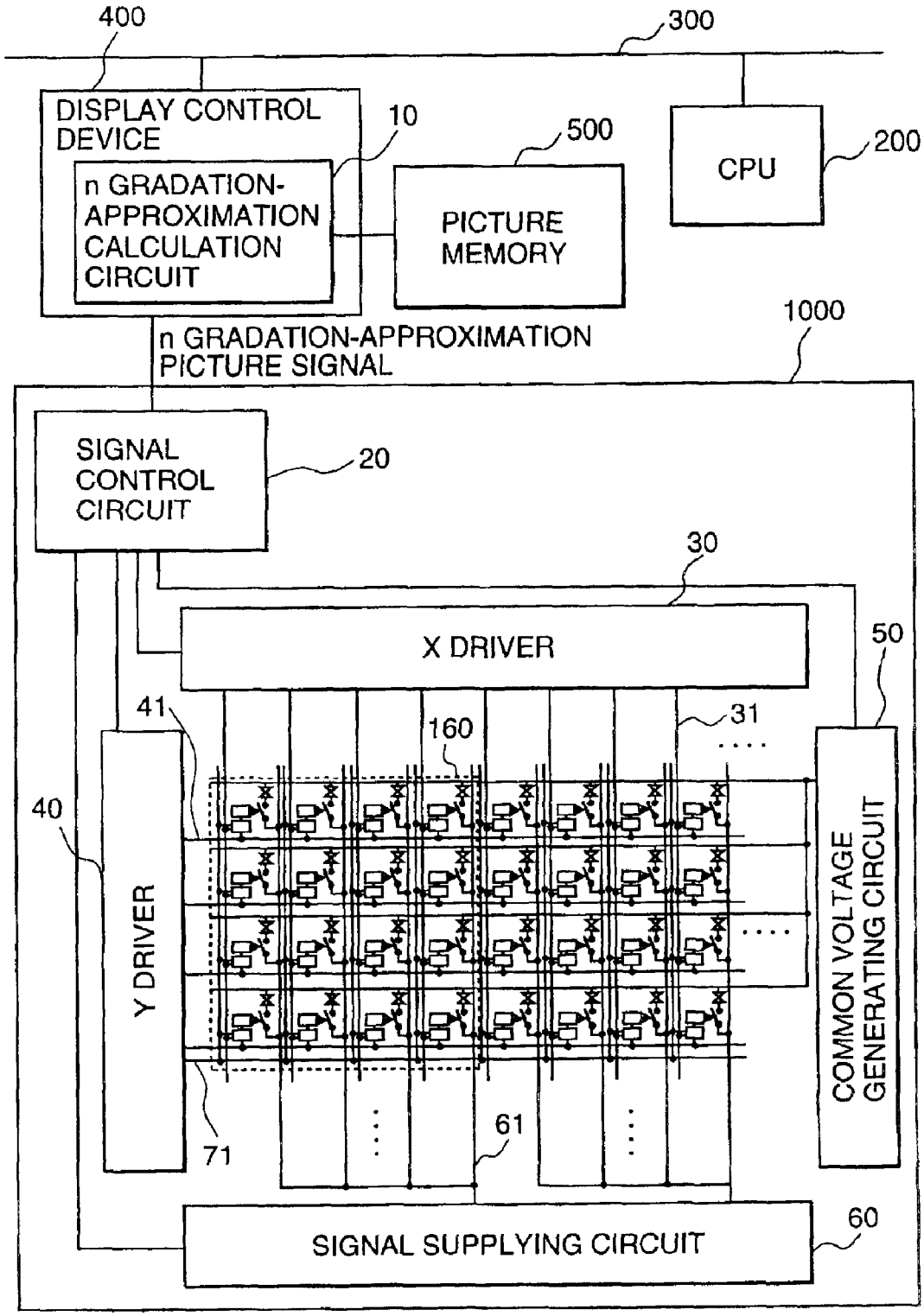
FIG. 20 shows whole configuration of embodiment 8 of the display system according to the present invention.

FIG. 20 shows whole configuration of embodiment 8 of the display system according to the present invention. This display system comprises a CPU 200 for generating an picture drawing instruction, and a display control 400 for generating a picture signal based on the picture drawing instruction, storing the generated picture signal in a memory 500, converting the generated picture signal into an n-gradation approximation picture signal approximated to binary gradation at every block by the built-in n-gradation approximation calculating circuit 10, and inputting the n-gradation approximation picture signal to the liquid crystal display apparatus 1000.

The liquid crystal display apparatus 1000 comprises a signal generation circuit 20 for supplying a desired signal to the X driver 30, the Y driver 40, the common voltage generating circuit 50, and the signal supply circuit 60, according to the input n-gradation approximation picture signal, and a plurality of pixel parts 100 provided at the intersection parts of an X signal line 31 connected to the X driver and extended in a Y direction and a Y signal line 41 connected to the Y driver 40 and extended in a X direction.

Because the n-gradation approximation calculating circuit is in display control 400, the signal input to liquid crystal display apparatus 1000 becomes a n-gradation approximation picture signal. when the high definition picture is displayed in the display system which uses the conventional liquid crystal display apparatus, the quality of picture is bound by the amount of the information input to the liquid crystal display apparatus.

In the case that this embodiment 8 is used, the n-gradation picture signal becomes a little amount of information compared with the picture signal. Therefore, the high definition picture can be displayed compared with the display system which uses prior art.

[Embodiment 9]

FIG. 21 shows whole configuration of embodiment 9 of the display system according to the present invention. This display system comprises a CPU 200 having the function of n-gradation approximation calculation, and a display control 400 for storing the n-gradation approximation picture signal supplied from the CPU via a bus line 300, and inputting the n-gradation approximation picture signal stored in a memory 500 to the liquid crystal display apparatus 1000.

The liquid crystal display apparatus 1000 comprises a signal generation circuit 20 for supplying a desired signal to the X driver 30, the Y driver 40, the common voltage generating circuit 50, and the signal supply circuit 60, according to the input n-gradation approximation picture signal, and a plurality of pixel parts 100 provided at the intersection parts of an X signal line 31 connected to the X driver and extended in a Y direction and a Y signal line 41 connected to the Y driver 40 and extended in a X direction.

Because the CPU has the function of calculation, the display control with low performance can be used in this display system.

[Embodiment 10]

Figure 22:
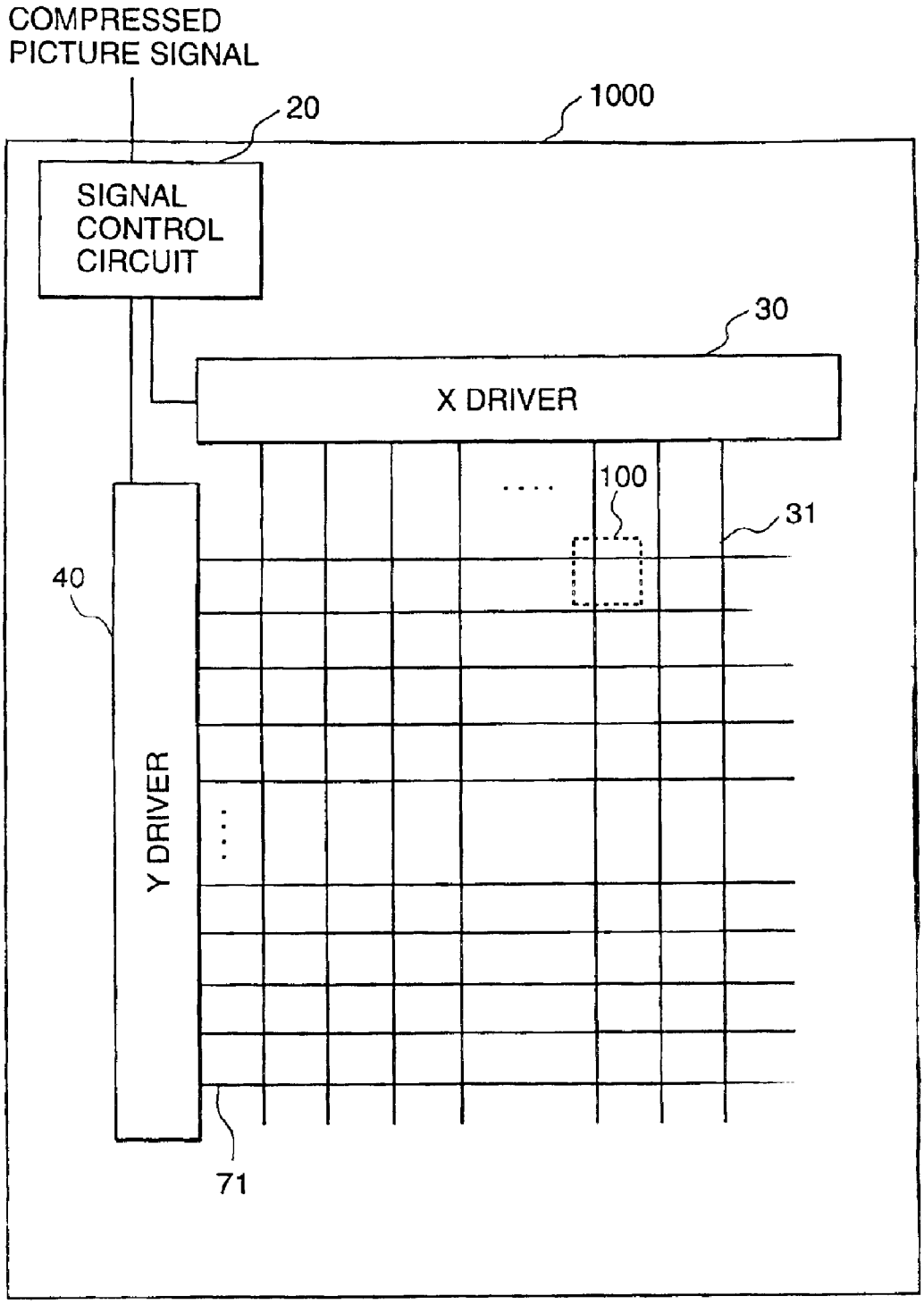
FIG. 22 shows whole configuration of embodiment 10 of the display system according to the present invention.

FIG. 22 is a block diagram showing the whole configuration of embodiment 10 of the display system according to the present invention.

The above description is performed from the viewpoint that a higher definition picture or higher-speed animation can be displayed because the selection period was able to be lengthened in the embodiments 1 to 9.

On the other hand, the present invention has the effect that the picture signal can be accurately input to the display apparatus even when the high definition picture or high-speed animation is displayed by decreasing the frequency of the signal to be input to the display apparatus.

By paying attention to the frequency of the signal input to this display apparatus with respect to the embodiments 1 to 9, the configuration of embodiment 10 shown in FIG. 22 is obtained.

The display apparatus 1000 according to the embodiment 10 comprises an X driver 30, a Y driver 40, a signal generation circuit 20 for supplying the desired signal to the X driver 30, the Y driver 40, and a common voltage generating circuit 50 (not shown) according to the input compression picture signal, and a plurality of pixel parts 100 provided at the intersection parts of an X signal line 31 connected to the X driver and extended in a Y direction and a Y signal line 41 connected to the Y driver 40 and extended in a X direction. The signal generation circuit 20 supplies the desired signal to signal supply circuit 60 if necessary like the embodiments 1 to 9. It is unnecessary to provide the signal supply circuit 60 if the X driver 30 or Y driver 40 combines the signal supply circuit 60.

The compression picture signal can be input to the display apparatus 1000, differently from the conventional display apparatus. That is, the data amount of the signal input to display apparatus 1000 per unit time is less than the apparent data amount of display per unit time.

For instance, the data amount per unit time displayed with 640×480 dots, RGB each color 8 bits, and the frame frequency 60 Hz, becomes 640×480×(3×8)×60=about 440 Mbits/sec.

On the other hand, the data amount input to the display apparatus 1000 is less than 440 Mbits/sec in this invention. For instance, in the embodiment 1, it is possible to write the liquid crystal drive voltage in the pixels of two blocks formed by four rows in two selection period while eight selection period is needed in the prior art. Therefore, the frequency of the selection period can be adjusted to ¼. Namely, the data amount of the signal input to the display apparatus 1000 becomes about 110 Mbits/sec, or ¼ of the conventional frequency.

As mentioned above, the data amount of the signal input to the display apparatus can be reduced according to the present invention. Therefore, when a high definition picture or high-speed animation is displayed, the desire picture can be displayed by using a usual cable.

Although the signal to which data amount was reduced by n-gradation approximation is used as a compression picture signal in the embodiment of the present invention, it is possibel to use the picture compression signal in which the data redundant for man's perception characteristic is reduced, for example, a signal in which data amount is reduced by orthogonal transformations used in JPEG.

What is claimed is:

1. A display apparatus comprises:

pixel electrodes arranged like a matrix;

display elements which operate according to the voltage of the pixel electrode;

an X driver for supplying an X signal to X signal line arranged in the column direction;

an Y driver for supplying an Y signal to Y signal line arranged in the row direction;

a liquid crystal drive voltage supplying circuit for supplying a liquid crystal drive voltage to a liquid crystal drive voltage line arranged in a column direction;

an XY calculating circuit provided at the intersection parts of the X signal line and the Y signal line and connected to the X signal line and the Y signal line for calculating and outputting the X and Y signals;

a signal comparator for comparing an output of the XY calculating circuit with a reference voltage and outputting a first voltage when the output of the XY calculating circuit is higher than the reference voltage, and a second voltage when lower than that;

a switch for controlling the connection of the pixel electrode and the liquid crystal drive voltage line, based on the output of the signal comparator;

n-gradation approximation calculating circuit for dividing the pixels into pixel blocks of N rows×N' columns, and converting the gradation level of each pixel of each block into n-gradation approximation picture signal approximated to n values less than N×N', and a signal control circuit for controlling the X driver, the Y driver, and liquid crystal drive voltage supplying circuit, according to the n-gradation approximation picture signal, wherein n is two, the XY calculating circuit comprises two capacitors connected in series between the X signal line and the Y signal line, wherein the voltage of the connection node of two capacitors is input to the signal comparator as an output value, wherein the voltage VYMAX applied to Y signal line is a high voltage enough to allow the output of the XY arithmetic circuit to be higher than the reference voltage of the signal comparator regardless of the voltage applied to X signal line, wherein the voltage VYMIN applied to Y signal line is a high voltage enough to allow the output of the XY arithmetic circuit to be lower than the reference voltage of the signal comparator regardless of the voltage applied to X signal line, wherein VYMAX is applied to Y signal lines of the first to N-th rows, and VYMIN is applied to Y signal lines other than the first to Nth row, for the first selection period, wherein the voltages VY1<VY2< . . . <VYN are applied to Y signal lines of the $1^{st}$ to N-th rows, VYMAX is applied to Y signal lines of the (N+1)-th to 2N-th rows, and VYMIN is applied to Y signal lines other than the first to 2Nth rows, for the second selection period, and wherein, for the i-th selection period, the voltages VY1<VY2< . . . <VYN are applied to Y signal lines of the ((i−2)×N+1)-th to ((i−1)×N)-th rows, VYMAX is applied to Y signal lines of the ((i−1)×N+1)-th to (i×N)-th rows, and VYMIN is applied to Y signal lines other than the ((i−2)×N+1)-th to (i×N)-th rows.

2. A display method in which a display signal for displaying a picture is independently applied to each of the pixels arranged like a matrix by using the wiring arranged in the directions of row and column, comprising the steps of:

dividing the pixels into pixel blocks of N rows×N' columns, and allocating the gradation of n values which are less number than N×N' of the pixels of a pixel block formed from N×N' pixels, wherein, during a predetermined period of time, pixels of a first pixel block of the divided pixel blocks are allocated a first of the n gradations and are given a first signal and pixels of a second pixel block, adjacent to the first pixel block, of the pixel blocks are allocated a second of the n gradations and are given a second signal, wherein n is two, the XY calculating circuit comprises a capacitor of which one terminal is connected to the Y signal line and the other terminal to a drain electrode, and a transistor of which a source electrode is connected to the X signal line;

wherein the voltage of the drain electrode of the transistor is input to the signal comparator as an output value, voltage VYMAX applied to Y signal line is a high voltage enough to allow the output of the XY arithmetic circuit to be higher than the reference voltage of the signal comparator regardless of the voltage applied to X signal line, voltage VYMIN applied to Y signal line is a high voltage enough to allow the output of the XY arithmetic circuit to be lower than the reference voltage of the signal comparator regardless of the voltage applied to X signal line, voltage VYMAX is applied to Y signal lines of the 1st to N-th rows, and VYMIN is applied to Y signal lines other than the first to N-th row, for the first selection period, the voltages VY1< VY2< . . . <VYN are applied to Y signal lines of the first to N-th rows, VYMAX is applied to Y signal lines of the (N+1)-th to 2N-th rows, and VYMIN is applied to Y signal lines other than the first to 2N-th rows, for the second selection period, and wherein, for the i-th selection period, the voltages VY1<VY2< . . . <VYN are applied to Y signal lines of the ((i−2)×N+1)-th to ((i−1)×N)-th rows, VYMAX is applied to Y signal line of the ((i−1)×N+1)th to (i×N)th rows, and VYMIN is applied to Y signal lines other than the ((i−2)×N+1)-th to (i×N)-th rows.

3. A display apparatus comprises:

pixel electrodes arranged like a matrix;

display elements which operate according to the voltage of the pixel electrode;

an X driver for supplying an X signal to X signal line arranged in the column direction;

an Y driver for supplying an Y signal to Y signal line arranged in the row direction;

a liquid crystal drive voltage supplying circuit for supplying a liquid crystal drive voltage to a liquid crystal drive voltage line arranged in a column direction;

an XY calculating circuit provided at the intersection parts of the X signal line and the Y signal line and connected to the X signal line and the Y signal line for calculating and outputting the X and Y signals;

a signal comparator for comparing an output of the XY calculating circuit with a reference voltage and outputting a first voltage when the output of the XY calculating circuit is higher than the reference voltage, and a second voltage when lower than that;

a switch for controlling the connection of the pixel electrode and the liquid crystal drive voltage line, based on the output of the signal comparator;

n-gradation approximation calculating circuit for dividing the pixels into pixel blocks of N rows×N' columns, and converting the gradation level of each pixel of each block into n-gradation approximation picture signal approximated to n values less than N×N', and a signal control circuit for controlling the X driver, the Y driver, and liquid crystal drive voltage supplying circuit, according to the n-gradation approximation picture signal, wherein n is two, the XY calculating circuit may comprise a capacitor of which one terminal is connected to the Y signal line and the other terminal to a drain electrode, and a transistor of which a source electrode is connected to the X signal line like the above-mentioned circuit, wherein the voltage of the drain electrode of the transistor is input to the signal comparator as an output value, wherein the voltage VYMAX applied to Y signal line is a high voltage enough to allow the output of the XY arithmetic circuit to be higher than the reference voltage of the signal comparator regardless of the voltage applied to X signal line, voltage VYMIN applied to Y signal line is a high voltage enough to allow the output of the XY arithmetic circuit to be lower than the reference voltage of the signal comparator regardless of the voltage applied to X signal line, wherein VYMAX is applied to Y signal lines of the first to N-th rows, and VYMIN is applied to Y signal lines other than the first to N-th rows, for the first selection period, wherein the voltages VY1<VY2< . . . <VYN are next applied to Y signal lines of the first to N-th rows, and VYMIN is applied to Y signal lines other than the first to N-th rows, for the second selection period, and wherein, for the (2×i−1)-th selection period (i=1,2,3, . . . ), VYMAX is applied to Y signal lines of the ((i−1)×N+1)-th to (i×N)-th rows, and VYMIN is applied to Y signal lines other than the ((i−1)×N+1)-th to (i×N)-th rows, wherein for the (2×i)-th selection period, the voltage VY1<VY2< . . . <VYN are applied to Y signal lines of the ((i−1)×N+1)-th to (i×N)-th rows, and VYMIN is applied to Y signal lines other than the ((i−1)×N+1) to (i×N)-th rows.

4. A display apparatus comprises:

pixel electrodes arranged like a matrix;

display elements which operate according to the voltage of the pixel electrode;

an X driver for supplying an X signal to X signal line arranged in the column direction;

an Y driver for supplying an Y signal to Y signal line arranged in the row direction;

a liquid crystal drive voltage supplying circuit for supplying a liquid crystal drive voltage to a liquid crystal drive voltage line arranged in a column direction;

an XY calculating circuit provided at the intersection parts of the X signal line and the Y signal line and connected to the X signal line and the Y signal line for calculating and outputting the X and Y signals;

a signal comparator for comparing an output of the XY calculating circuit with a reference voltage and outputting a first voltage when the output of the XY calculating circuit is higher than the reference voltage, and a second voltage when lower than that;

a switch for controlling the connection of the pixel electrode and the liquid crystal drive voltage line, based on the output of the signal comparator;

n-gradation approximation calculating circuit for dividing the pixels into pixel blocks of N rows×N' columns, and converting the gradation level of each pixel of each block into n-gradation approximation picture signal approximated to n values less than N×N', and a signal control circuit for controlling the X driver, the Y driver, and liquid crystal drive voltage supplying circuit, according to the n-gradation approximation picture signal, wherein in each of N' columns in i=1, 2, . . . 3 in such a display apparatus, wherein the liquid crystal drive voltage lines of the ((2×i−2)×N+1)-th to ((2×i−1)×N)-th rows are connected to one another, the liquid crystal drive voltage lines of the ((2×i−1)×N+1)-th to (2×i×N)-th rows is connected to one another, and the liquid crystal drive voltage lines of the ((2×i−2)×N+1)-th to ((2×i−1)×N)-th rows and the liquid crystal drive voltage lines of the ((2×i−1)×N+1)-th to (2×i×N)-th rows are not connected to one another.

5. A display apparatus comprises:

pixel electrodes arranged like a matrix;

display elements which operate according to the voltage of the pixel electrode;

an X driver for supplying an X signal to X signal line arranged in the column direction;

an Y driver for supplying an Y signal to Y signal line arranged in the row direction;

a liquid crystal drive voltage supplying circuit for supplying a liquid crystal drive voltage to a liquid crystal drive voltage line arranged in a column direction;

an XY calculating circuit provided at the intersection parts of the X signal line and the Y signal line and connected to the X signal line and the Y signal line for calculating and outputting the X and Y signals;

a signal comparator for comparing an output of the XY calculating circuit with a reference voltage and outputting a first voltage when the output of the XY calculating circuit is higher than the reference voltage, and a second voltage when lower than that;

a switch for controlling the connection of the pixel electrode and the liquid crystal drive voltage line, based on the output of the signal comparator;

n-gradation approximation calculating circuit for dividing the pixels into pixel blocks of N rows×N' columns, and converting the gradation level of each pixel of each block into n-gradation approximation picture signal approximated to n values less than N×N', and a signal control circuit for controlling the X driver, the Y driver, and liquid crystal drive voltage supplying circuit, according to the n-gradation approximation picture signal, wherein n is two, and the XY calculating circuit comprises a capacitor of which one terminal is connected to the Y signal line and the other terminal to a drain electrode, and a transistor of which a source electrode is connected to the X signal line, wherein the voltage of the drain electrode of the transistor is input to the signal comparator as an output value, VYMAX and VYMID applied to Y signal line are set to a high voltage enough to allow the value of VX+VYMAX+VMID to be higher than the reference voltage of the signal comparator regardless of the value of the voltage VX applied to X signal line, VYMIN applied to Y signal line is set to a high voltage enough to allow the output of the XY arithmetic circuit to be lower than the reference voltage of the signal comparator regardless of the voltage applied to X signal line, wherein for the first selection period, VYMID is applied to Y signal lines of the first to N-th rows, VYMIN is applied to Y signal lines other than the first to N-th rows, wherein for the second selection period, VYMAX is applied to Y signal lines of the first to N-th rows, wherein VYMID is applied to Y signal lines other than the (N+1)-th to 2N-th rows, VYMIN is applied to Y signal lines other than the first to 2N-th rows, wherein for the third selection period, the voltages VY1<VY2< . . . <VYN are applied to Y signal lines of the first to N-th rows, VYMAX is applied to Y signal lines of the (N+1)-th to 2N-th rows, wherein VYMID is applied to Y signal lines of the (2N+1)-th to 3N-th rows, and VYMIN is applied to Y signal lines other than the first to 3N-th rows, and wherein for the i-th selection period, the voltages VY1<VY2< . . . <VYN are applied to Y signal lines of the ((i−1)×N+1)-th to ((i−2)×N)-th rows, VYMAX is applied to Y signal lines of the ((i−2)×N+1)-th to ((i−1)×N)-th rows, VYMID is applied to Y signal lines of the ((i−1) ×N+1)-th to (i×N)-th rows, and VYMIN is applied to Y signal lines other than the ((i−3)×N+1)-th to (i×N)-th rows.

* * * * *